US010724702B2

(12) United States Patent
Kinoshita et al.

(10) Patent No.: US 10,724,702 B2
(45) Date of Patent: Jul. 28, 2020

(54) VEHICULAR LAMP FITTING

(71) Applicant: STANLEY ELECTRIC CO., LTD., Tokyo (JP)

(72) Inventors: Kayuri Kinoshita, Tokyo (JP); Sadayuki Konishi, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/444,700

(22) Filed: Jun. 18, 2019

(65) Prior Publication Data

US 2019/0390834 A1 Dec. 26, 2019

(30) Foreign Application Priority Data

Jun. 21, 2018 (JP) ..... 2018-118350

(51) Int. Cl.

| | |
|---|---|
| ***F21S 41/29*** | (2018.01) |
| ***F21S 41/25*** | (2018.01) |
| ***F21W 102/16*** | (2018.01) |
| ***F21S 41/24*** | (2018.01) |

(52) U.S. Cl.

CPC ..... *F21S 41/295* (2018.01); *F21S 41/25* (2018.01); *F21S 41/24* (2018.01); *F21S 41/29* (2018.01); *F21W 2102/16* (2018.01)

(58) Field of Classification Search

CPC ..... F21S 41/295; F21S 41/25; F21S 41/24; F21S 41/29; F21W 2102/16

USPC ..... 362/511, 543–545

See application file for complete search history.

(56) References Cited

U.S. PATENT DOCUMENTS

| | | | | |
|---|---|---|---|---|
| 7,810,975 | B2 * | 10/2010 | Specht | F21S 41/143 362/555 |
| 8,550,658 | B2 * | 10/2013 | Hansler | B64F 1/20 362/231 |
| 8,960,978 | B2 * | 2/2015 | Uchida | B60Q 1/16 362/511 |
| 2010/0226142 | A1 | 9/2010 | Brendle et al. | |

(Continued)

FOREIGN PATENT DOCUMENTS

| | | | |
|---|---|---|---|
| DE | 20 2017 005 367 | U1 | 11/2017 |
| JP | 2015-079660 | A | 4/2015 |

(Continued)

OTHER PUBLICATIONS

The extended European Search Report for the related European Patent Application No. 19181385.6 dated Nov. 21, 2019.

*Primary Examiner* — Laura K Tso

(74) *Attorney, Agent, or Firm* — Kenealy Vaidya LLP

(57) ABSTRACT

A vehicular lamp fitting, comprising a projection lens, a separator that is disposed behind the projection lens, a low beam light source and an ADB light source that are disposed behind the separator, wherein the separator includes an upper separator main body, and a lower separator main body, and a first region (a lower portion of an upper entry surface of the projection lens and an upper portion of a lower entry surface of the projection lens) matches the focal plane of the projection lens, a second region (a portion above the lower portion of the upper entry surface of the projection lens) is disposed ahead of or behind the focal plane of the projection lens, and a third region (a portion below the upper portion of the lower entry surface of the projection lens) is disposed ahead of or behind the focal plane of the projection lens.

18 Claims, 27 Drawing Sheets

(56) References Cited

U.S. PATENT DOCUMENTS

| | | | | |
|---|---|---|---|---|
| 2015/0131305 | A1* | 5/2015 | Courcier | F21S 41/141<br>362/516 |
| 2015/0131324 | A1* | 5/2015 | de Lamberterie | G02B 6/0035<br>362/623 |
| 2017/0089536 | A1 | 3/2017 | Courcier et al. | |
| 2018/0087736 | A1 | 3/2018 | Joerg et al. | |
| 2018/0313511 | A1 | 11/2018 | Lee | |
| 2019/0086050 | A1 | 3/2019 | Dikau et al. | |
| 2019/0323672 | A1* | 10/2019 | Nishimura | F21S 41/151 |

FOREIGN PATENT DOCUMENTS

| | | | |
|---|---|---|---|
| JP | 2015-79660 | A | 4/2015 |
| WO | 2017/198516 | A1 | 11/2017 |

* cited by examiner

VEHICULAR LAMP FITTING

CROSS-REFERENCE TO RELATED APPLICATION

This application is based upon and claims the benefit of priority of the prior Japanese Patent Application No. 2018-118350, filed on Jun. 21, 2018, the entire contents of which are incorporated herein by reference.

FIELD

The present invention relates to a vehicular lamp fitting, and more particularly to a vehicular lamp fitting which can form: a low beam light distribution pattern of which length in the vertical direction is longer, density is lower (brightness range is smaller), and maximum luminous intensity is lower compared with an ADB light distribution pattern; and an ADB light distribution pattern of which contour is moderately blurred.

BACKGROUND

Conventionally a vehicular lamp fitting including: a projection lens constituted by a first lens and a second lens; a light guiding lens disposed behind the projection lens; and a low beam light source that is disposed behind the light guiding lens, and emits light which passes through the light guiding lens and projection lens in this sequence, and is irradiated forward to form a low beam light distribution pattern, has been proposed (e.g. Japanese Laid-open Patent Publication No. 2015-79660 (FIG. 1, etc.)). A focal plane of the projection lens and an exit surface of the light guiding lens, through which the light from the low beam light source exits (and an entry surface of the projection lens through which the light from the low beam light source, which exited through the exit surface of the light guiding lens, enters), are both spherical surfaces (spherical surfaces of which curvature is constant) and match (surface-contacted).

The present inventors examined whether an ADB light source, that emits light which passes through the light guiding lens and projection lens in this sequence and is irradiated forward to form an ADB light distribution pattern, is added to the above mentioned prior art. The focal plane of the projection lens and an exit surface of the light guiding lens, through which the light from the ADB light source exit (and an entry surface of the projection lens through which the light from the ADB light source, which exited through the exit surface of the light guiding lens, enters), are both spherical surfaces (spherical surfaces of which curvature is constant) and match (surface-contacted).

PRIOR ART

[Patent Document 1] Japanese Laid-open Patent Publication No. 2015-79660

SUMMARY

However, through study, the inventors discovered that the low beam light distribution pattern is demanded to have a longer length in the vertical direction, lower density (smaller brightness range) and lower maximum luminous intensity compared with the ADB light distribution pattern, but in the case when the focal plane of the projection lens and the exit surface of the light guiding lens, through which the light from the low beam light source exits (and the entry surface of the projection lens through which the light from the low beam light source, which exited through the exit surface of the light guiding lens, enters), are both spherical surfaces (spherical surfaces of which curvature is constant) and match, and also when the focal plane of the projection lens and the exit surface of the light guiding lens through which the light from the ADB light source exits (and the entry surface of the projection lens through which the light from the ADB light source, which exited through the exit surface of the light guiding lens, enters), are both spherical surfaces (spherical surfaces of which curvature is constant) and match, it turns out that: (1) the low beam light distribution pattern and ADB light distribution pattern have vertically symmetrical shapes and luminous intensity distribution (e.g. FIG. 19A), (2) the above mentioned low beam light distribution pattern that is demanded is not formed, (3) the contour of the ADB light distribution pattern becomes clear and the naturalness of light distribution is diminished.

With the foregoing in view, it is an object of the present invention to provide a vehicular lamp fitting which can form: a low beam light distribution pattern of which length in the vertical direction is longer, density is lower (brightness range is smaller) and maximum luminous intensity is lower compared with an ADB light distribution pattern; and an ADB light distribution pattern of which contour is moderately blurred.

In order to achieve the object described above, an aspect of the present invention provides a vehicular lamp fitting, comprising: a projection lens; a separator that is disposed behind the projection lens; a low beam light source that is disposed behind the separator, and emits light which passes through the separator and the projection lens in sequence, and is irradiated forward to form a low beam light distribution pattern, further comprising an ADB light source that emits light which passes through the separator and the projection lens in sequence, and is irradiated forward to form an ADB light distribution pattern, wherein the separator includes: an upper separator main body constituted by a front surface and a back surface on the opposite side of the front face; a first light guiding unit which extends from a lower portion of the upper separator main body toward the low beam light source, and has a first entry surface facing the low beam light source at the front end; a lower separator main body constituted by a front surface and a back surface on the opposite side of the front surface; and a second light guiding unit which extends from an upper portion of the lower separator main body toward the ADB light source, and has a second entry surface facing the ADB light source at the front end, the projection lens includes a front surface and a back surface on the opposite side of the front surface, the back surface of the projection lens includes an upper entry surface facing the front surface of the upper separator main body, and a lower entry surface facing the front surface of the lower separator main body, the low beam light source, the first light guiding unit, the upper separator main body and the upper entry surface are disposed above a reference axis, which passes through a focal point of the projection lens and extends in the longitudinal direction of the vehicle, the ADB light source, the second light guiding unit, the lower separator main body and the lower entry surface are disposed below the reference axis, and when it is assumed that a first region is a lower portion of an upper entry surface of the projection lens and an upper portion of a lower entry surface of the projection lens, a second region is a portion above the lower portion of the upper entry surface of the projection lens, and a third region is a portion below the upper portion of the lower entry surface of the projection lens, the first region matches the focal plane of the projection lens, the second region is disposed ahead of or behind the focal plane of the projection lens, and the third region is disposed ahead of or behind the focal plane of the projection lens.

In addition, in a preferred aspect of the invention described above, the lower portion of the front surface of the upper separator main body is surface-contacted with the lower portion of the upper entry surface of the projection lens, a space is formed between a portion above the lower portion of the front surface of the upper separator main body and a portion above the lower portion of the upper entry surface of the projection lens, and the front surface of the lower separator main body is surface-contacted with the lower entry surface of the projection lens.

In addition, in a preferred aspect of the invention described above, the projection lens is constituted by optical surfaces of one or more lenses, except for the back surface of the lens disposed last.

DESCRIPTION OF EMBODIMENTS

A vehicular lamp 10 (corresponding to a vehicular headlamp according to the present invention) according to an embodiment of the present invention is described below with reference to the attached drawings. Corresponding components in each drawing are denoted by the same reference symbols and overlapping descriptions are omitted.

Figure 1:
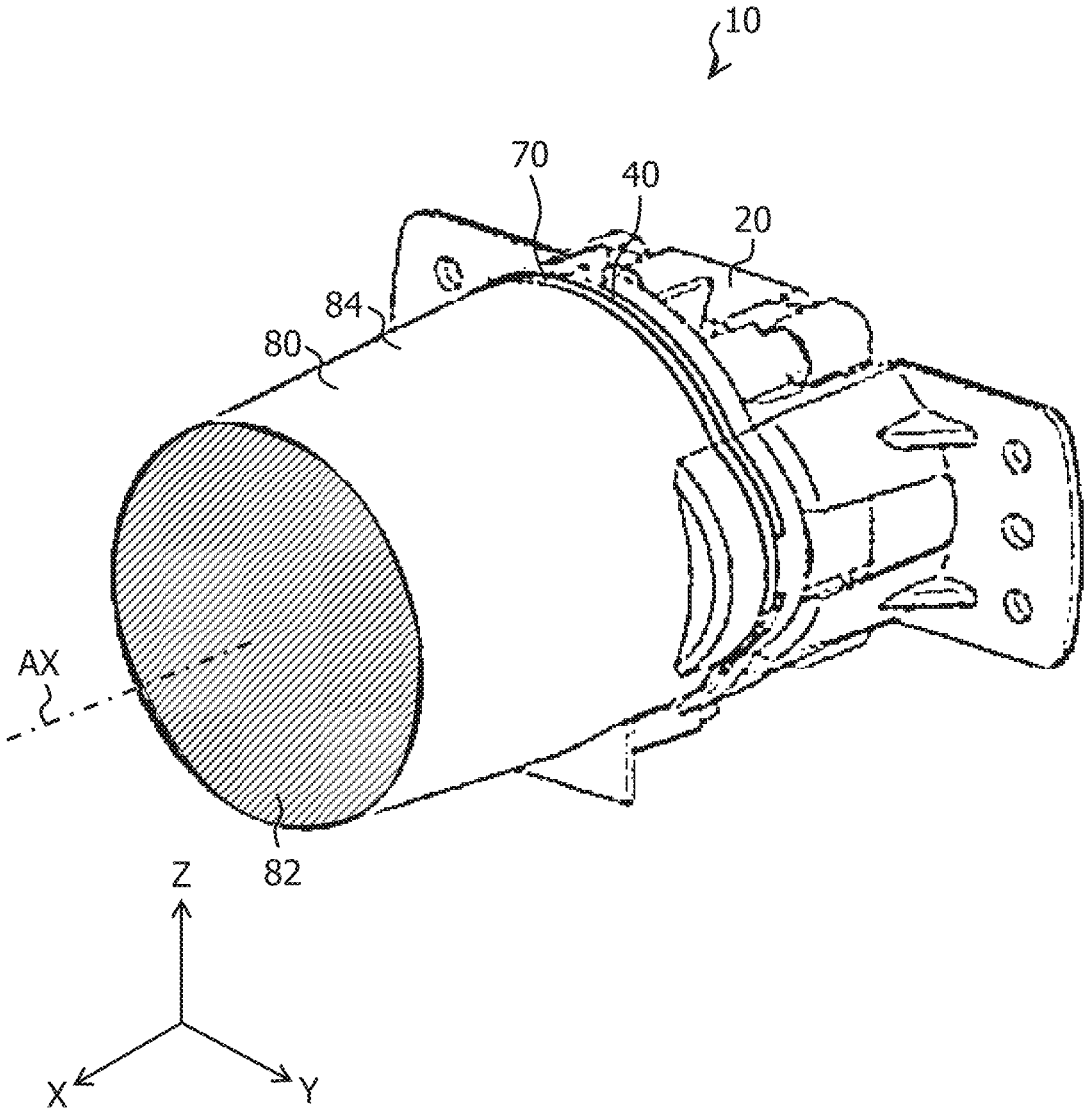
FIG. 1 is a perspective view depicting a vehicular lamp fitting 10.
Figure 2A:
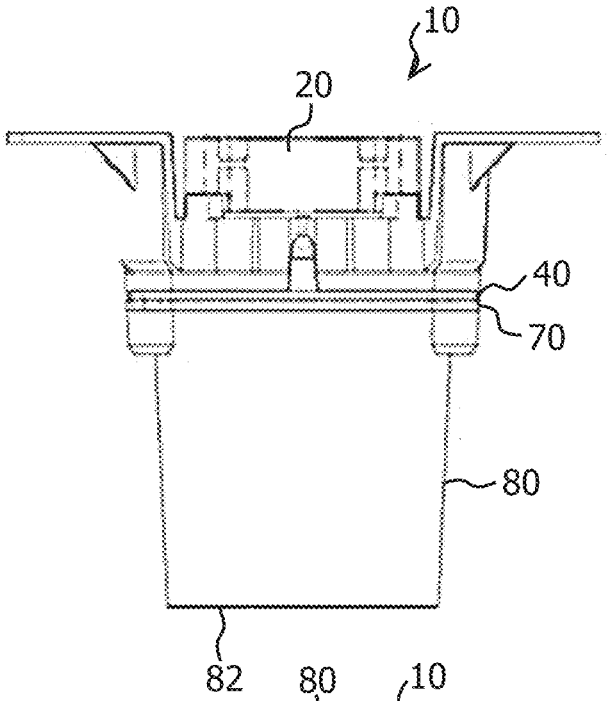
FIG. 2A is a top view.
Figure 2B:
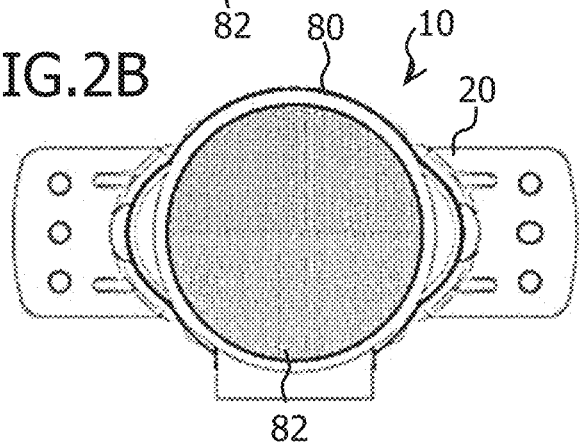
FIG. 2B is a front view.
Figure 2C:
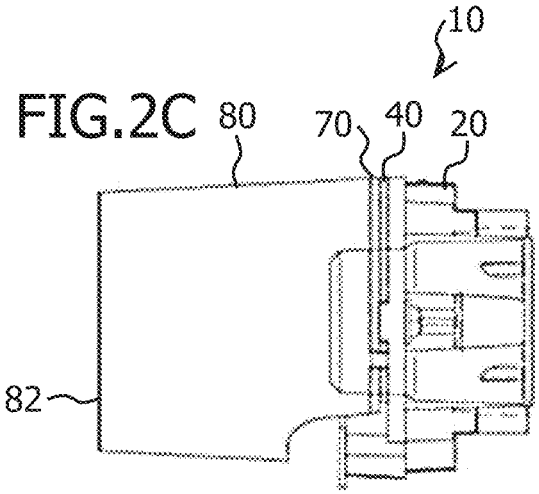
FIG. 2C is a side view of the vehicular lamp fitting 10.

FIG. 1 is a perspective view depicting a vehicular lamp fitting 10. FIG. 2A is a top view, FIG. 2B is a front view, and FIG. 2C is a side view of the vehicular lamp fitting 10.

The vehicular lamp fitting 10 illustrated in FIG. 1 and FIG. 2 is a vehicular head light that can form a low beam light distribution pattern $P_{Lo}$ (see FIG. 9A) or a composite light distribution pattern (see FIG. 9C) which includes a low beam light distribution pattern $P_{Lo}$ and an ADB (Adaptive Driving Beam) light distribution pattern $P_{ADB}$, and is mounted on the left and right of the front end of a vehicle (not illustrated). The low beam light distribution pattern $P_{Lo}$ and the ADB light distribution pattern $P_{ADB}$ are formed on a virtual vertical screen (formed at about 25 m ahead of the front surface of the vehicle) which faces the front surface of the vehicle. To make explanation easier, the X, Y and Z axes are defined. The X axis extends in the vehicle length direction, the Y axis extends in the vehicle width direction, and the Z axis extends in the vertical direction.

Figure 3:
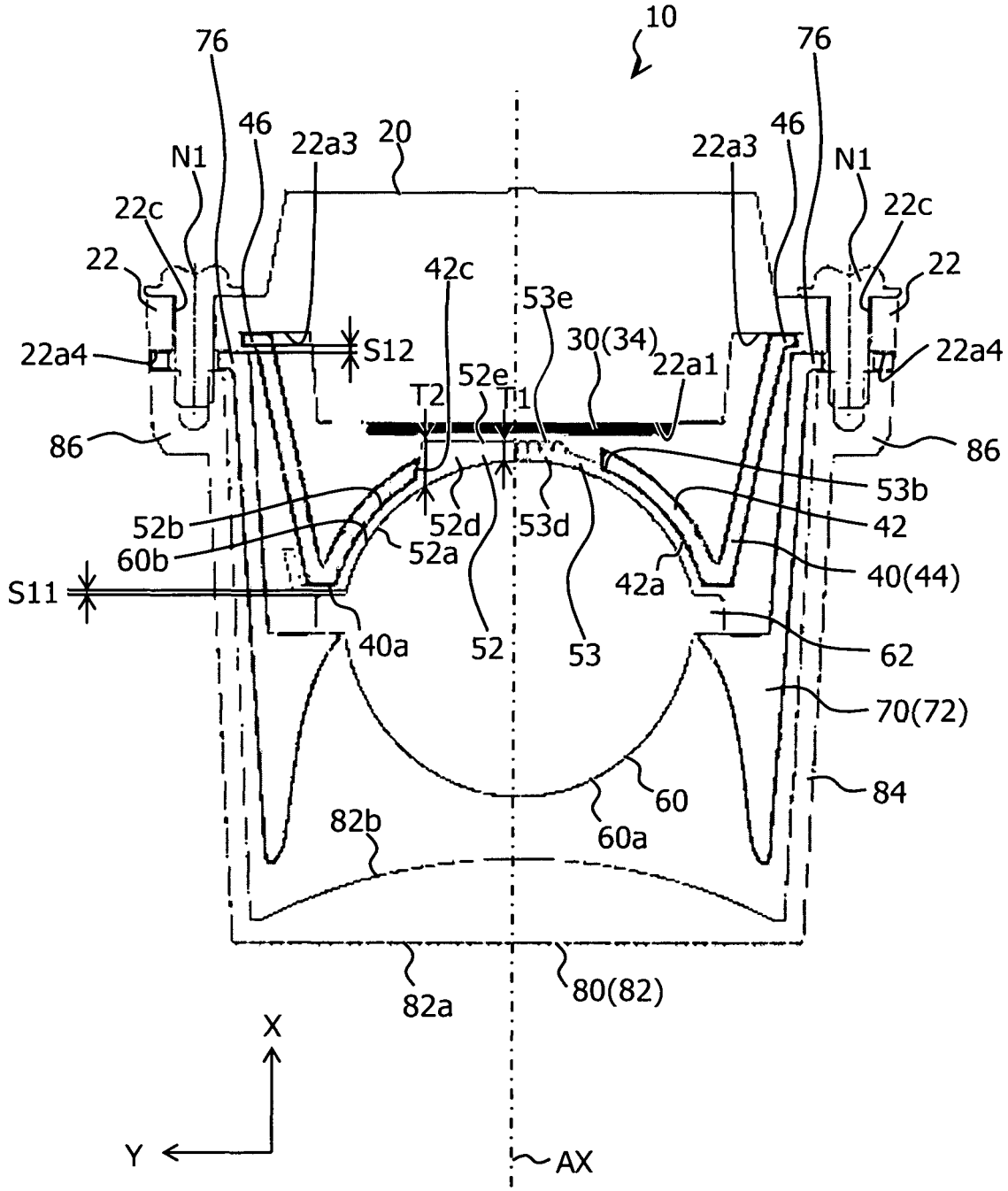
FIG. 3 is a cross-sectional view of the vehicular lamp fitting 10 illustrated in FIG. 1 sectioned at a horizontal plane which includes the reference axis AX (plane which includes the X axis and the Y axis).
Figure 4:
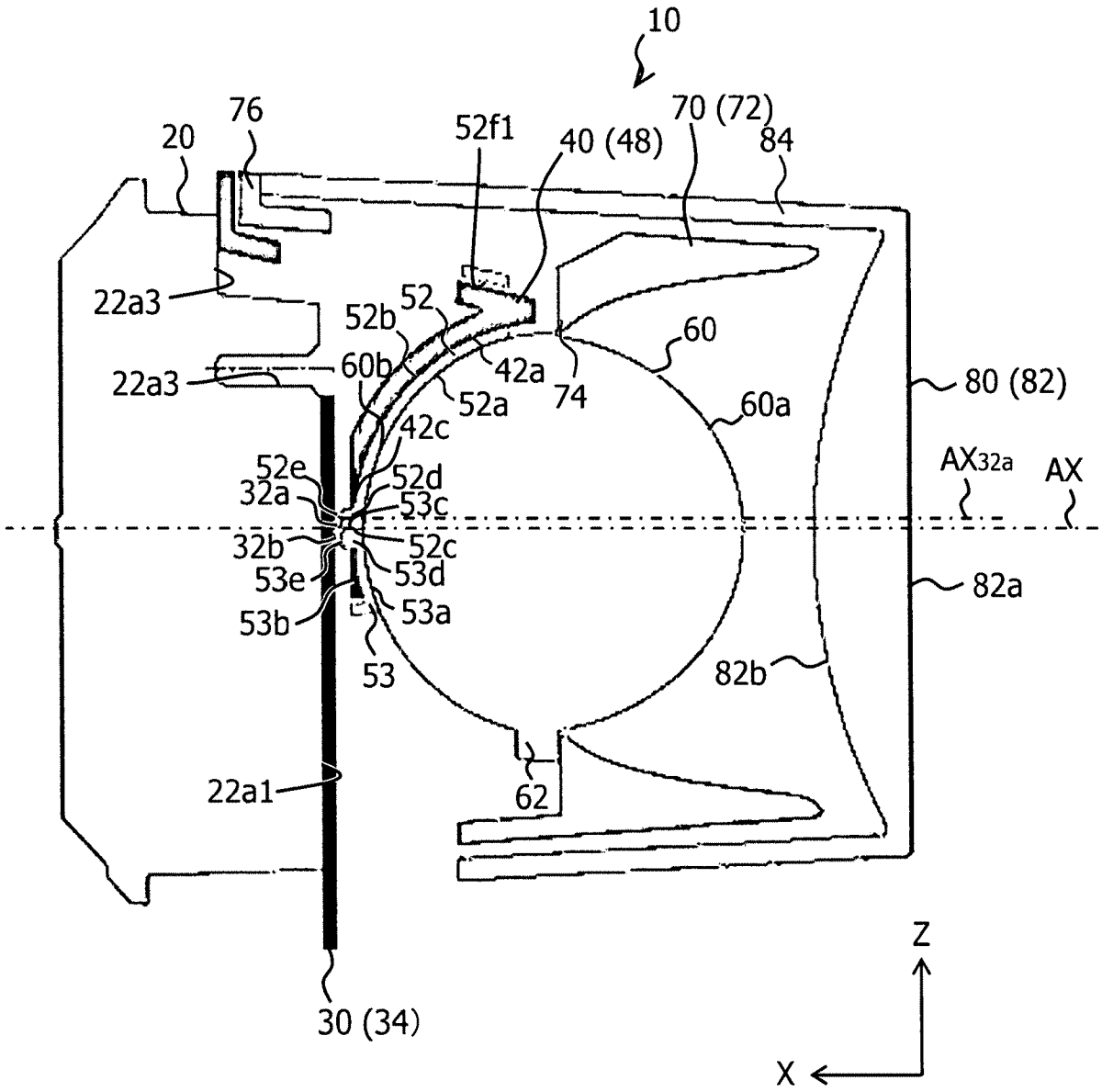
FIG. 4 is a cross-sectional view of the vehicular lamp fitting 10 illustrated in FIG. 1 sectioned at a vertical plane which includes the reference axis AX (plane which includes the X axis and the Z axis).
Figure 5:
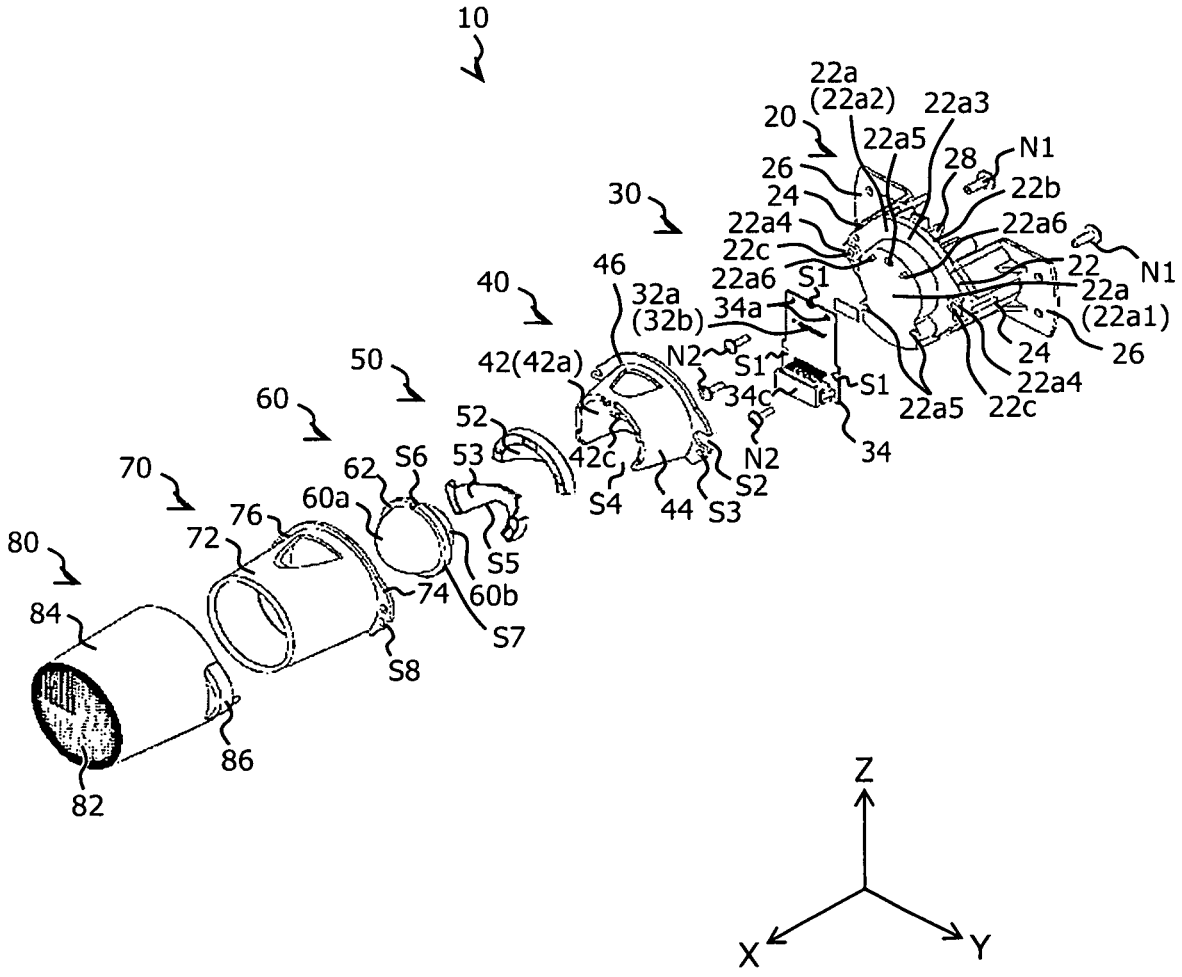
FIG. 5 is an exploded perspective view of the vehicular lamp fitting 10.

FIG. 3 is a cross-sectional view of the vehicular lamp fitting 10 illustrated in FIG. 1 sectioned at a horizontal plane which includes the reference axis AX (plane which includes the X axis and the Y axis). FIG. 4 is a cross-sectional view of the vehicular lamp fitting 10 illustrated in FIG. 1 sectioned at a vertical plane which includes the reference axis AX (plane which includes the X axis and the Z axis). FIG. 5 is an exploded perspective view of the vehicular lamp fitting 10.

As illustrated in FIG. 3 to FIG. 5, the vehicular lamp fitting 10 of this embodiment includes a heat sink 20, a light source module 30, a holder 40, a separator 50, a primary lens 60, a retainer 70, a secondary lens 80 and the like. The vehicular lamp fitting 10 is disposed in a lamp chamber (not illustrated) constituted by an outer lens and a housing, and is installed in the housing.

As illustrated in FIG. 5, the heat sink 20, which is made of die cast aluminum, includes a base 22 having a front surface 22*a*, and a back surface 22*b* on the opposite side of the front surface 22*a*.

The front surface 22*a* includes a light source module mounting surface 22*a*1, and a peripheral surface 22*a*2 surrounding the light source module mounting surface 22*a*1.

The light source module mounting surface 22*a*1 and the peripheral surface 22*a*2 are planes that are parallel with a plane which includes the Y axis and the Z axis, for example.

In the light source module mounting surface 22*a*1, screw holes 22*a*5 (three locations in FIG. 5) are disposed to fix the light source module 30 by screwing. In the light source module mounting surface 22*a*1, positioning pins 22*a*6 (two locations in FIG. 5) are disposed to position the light source module 30.

The peripheral surface 22*a*2 includes a holder contact surface 22*a*3 with which the holder 40 contacts, and a retainer contact surface 22*a*4 with which the retainer 70 contacts.

The retainer contact surface 22*a*4 is disposed on the left and right side of the peripheral surface 22*a*2 respectively.

The thickness between the retainer contact surface 22*a*4 and the back surface 22*b* (thickness in the X axis direction) is thicker than the thickness between the holder contact surface 22*a*3 and the back surface 22*b* (thickness in the X axis direction), whereby a step difference is formed.

In the base 22, screw holes 22*c* (two locations in FIG. 3), where screws N1 are inserted, are disposed. The screw holes 22*c* penetrate the retainer contact surface 22*a*4 and the back surface 22*b*.

On the left and right sides of the base 22, the first extended portion 24 which is extend backward (X axis direction) from the left and right sides of the base 22 respectively is formed. On the front end of the first extended portion 24, a second extended portion 26 which is extend sideways (Y axis direction) is formed.

A radiation fin 28 is disposed on the back surface 22*b* of the base 22.

The light source module 30 includes: a plurality of low beam light sources 32*a*; a plurality of ADB light sources 32*b*; and a substrate 34 on which the plurality of low beam light sources 32*a*, the plurality of ADB alight sources 32*b* and a connector 34*c* are mounted.

Figure 8A:
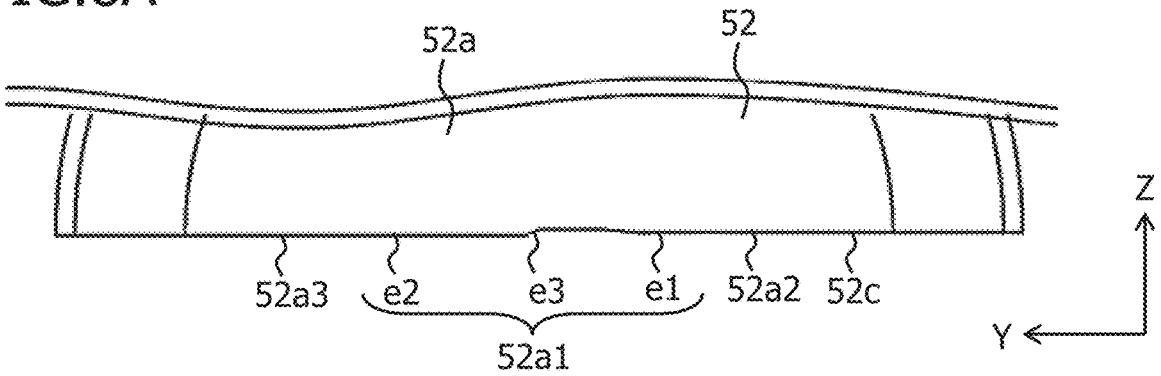
FIG. 8A is a partialfront view of the upper separator main body 52.
Figure 8B:
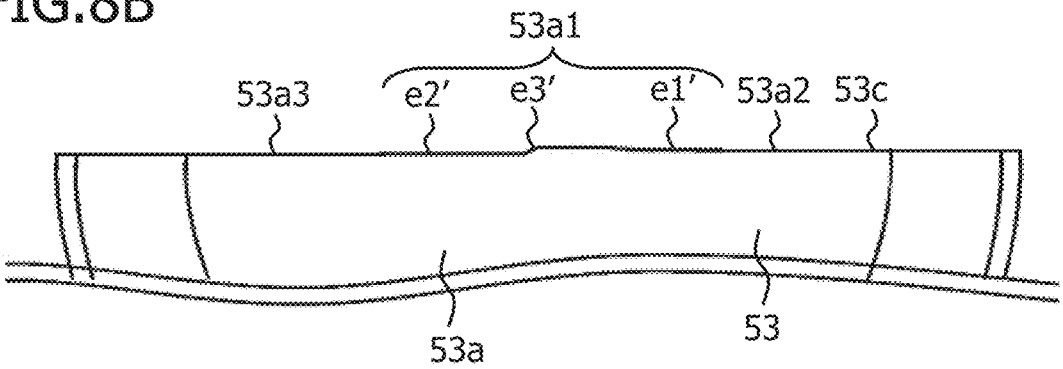
FIG. 8B is a partialfront view of the lower separator main body 53.
Figure 8C:
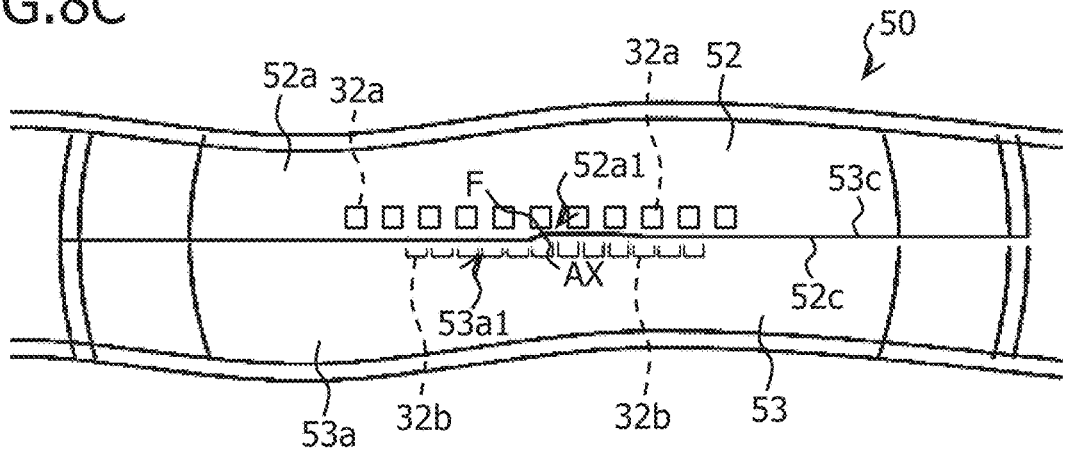
FIG. 8C is a front view (perspective view) of the plurality of low beam light sources 32*a* and the plurality of ADB light sources 32*b* when viewed through the separator 50.

FIG. 8C is a front view (perspective view) of the plurality of low beam light sources 32*a* and the plurality of ADB light sources 32*b* when viewed through the separator 50.

As illustrated in FIG. 8C, the plurality of low beam light sources 32*a* are arranged in a line in the Y-axis direction on the upper stage. The plurality of ADB light sources 32*b* are arranged in a line in the Y-axis direction on the lower stage.

Each of the light sources 32*a* and 32*b* is a semiconductor light-emitting element (e.g. LED or LD) having a rectangular light-emitting surface (e.g. 1 millimeter square). Each of the light sources 32*a* and 32*b* is mounted on the substrate 34 in a state of each light-emitting surface facing forward (front surface). Each of a plurality of rectangles in FIG. 8C indicates the light-emitting surface of the light source 32*a* or 32*b* respectively.

In the substrate 34, through holes 34*a* (two locations in FIG. 5) to which the positioning pins 22*a*6 of the heat sink 20 are inserted, and notches S1 (three locations in FIG. 5) to which screws N2 are inserted, are formed.

The light source module 30 having the above configuration is fixed to the heat sink 20 (light source module mounting surface 22*a*1) by screwing the screws N2 inserted in the notches S1 into the screw holes 22*a*5 of the heat sink 20 in a state where the positioning pins 22*a*6 of the heat sink 20 are inserted into the through holes 34*a* of the substrate 34.

As illustrated in FIGS. 3 to 5, the holder 40 is made of synthetic resin (e.g. acrylic and polycarbonate), and includes a cup-shaped holder main body 42 of which front side is open and rear side is closed.

A front surface 42*a* of the holder main body 42 is configured as a surface (a concave spherical surface facing backward) having an inverted shape of the back surface of the separator 50 (back surface 52*b* of an upper separator main body 52 and a back surface 53*b* of the lower separator main body 53), so that the back surface of the separator 50 is surface-contacted.

In the holder main body 42, a through hole 42*c*, to which a first light guiding unit 52*d* and a second light guiding unit 53*d* of the separator 50 are inserted, is formed.

In the holder main body 42, a cylindrical unit 44 which is extend backward (X axis direction) from the outer periphery of the holder main body 42 is disposed. In the front end of the cylindrical unit 44, a flange unit 46, which contacts a holder contact surface 22*a*3 of the heat sink 20, is disposed.

In the holder main body 42 (and the cylindrical unit 44), a notch S4 is disposed.

In the front opening end face 40*a* of the holder 40, a convex portion 48 and a convex portion 49 are disposed.

Figure 6:
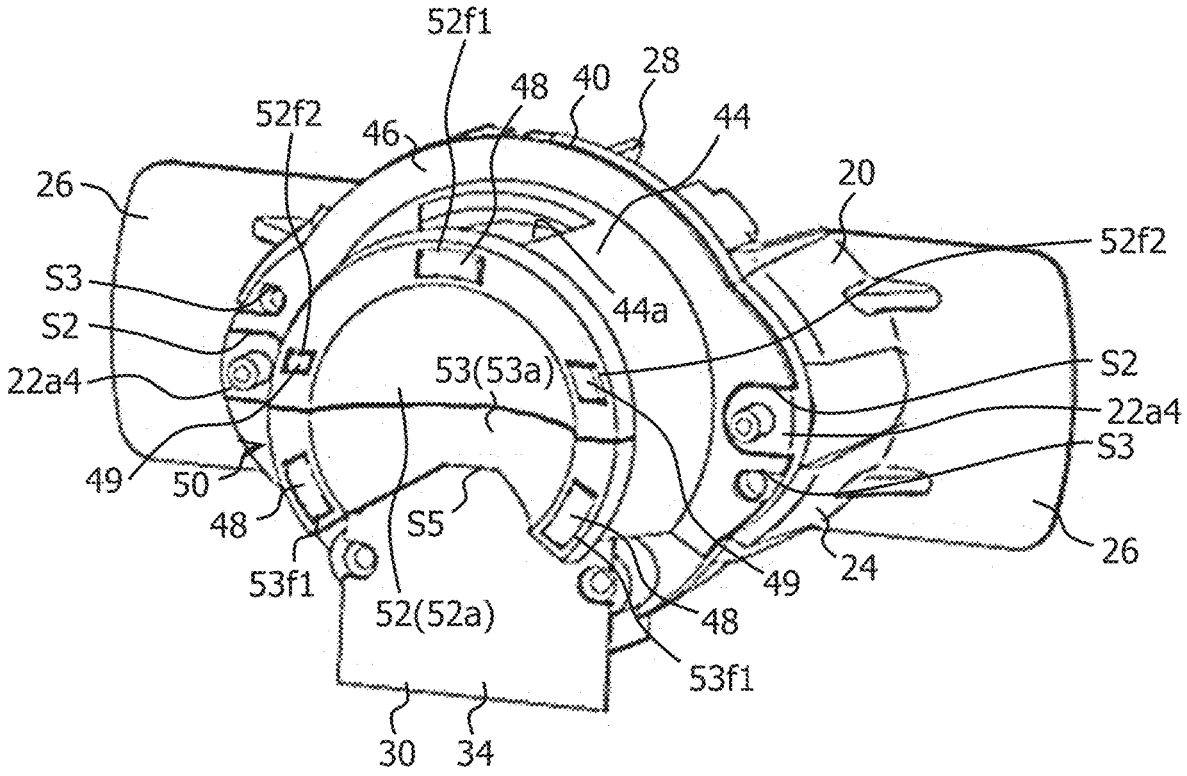
FIG. 6 is a perspective view depicting a structure constituted by the heat sink 20, the light source module 30, the holder 40 and the separator 50.

FIG. 6 is a perspective view depicting a structure constituted by the heat sink 20, the light source module 30, the holder 40 and the separator 50.

Figure 7:
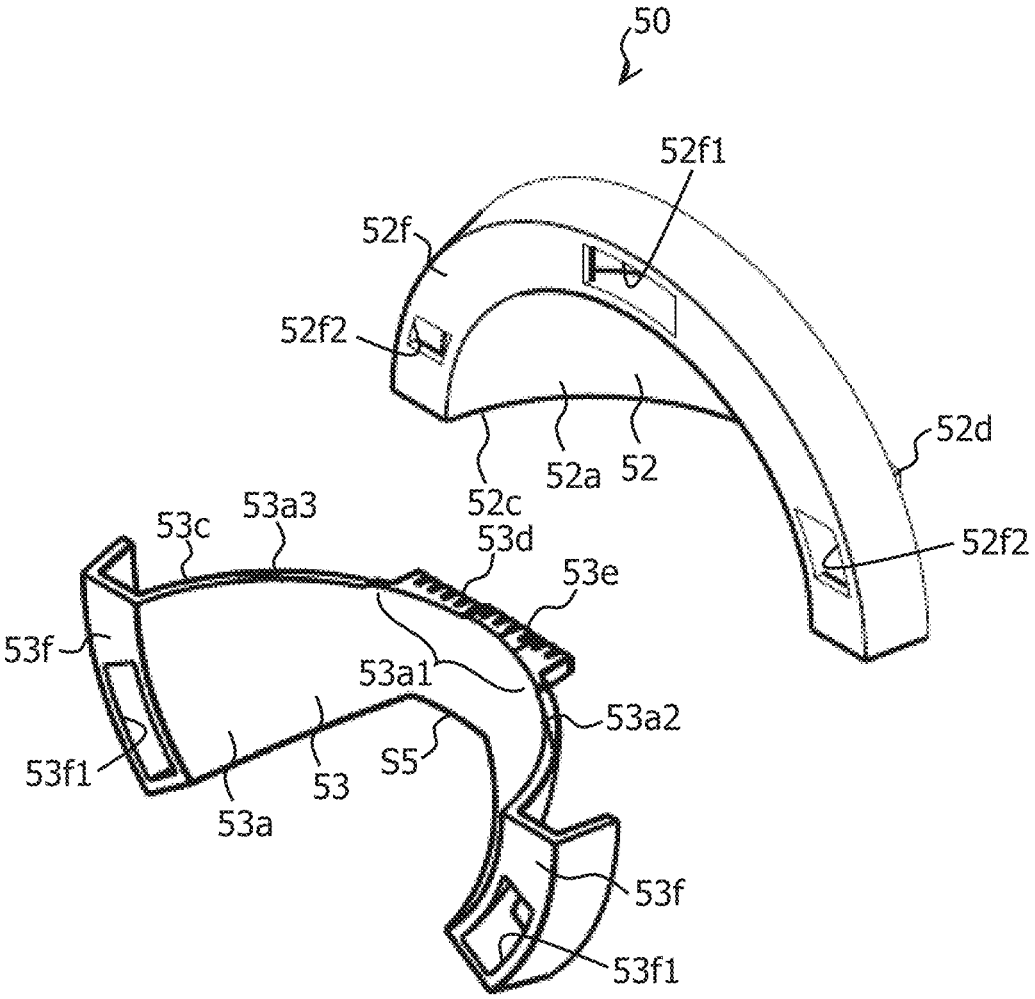
FIG. 7 is a perspective view of the separator 50.

FIG. 7 is a perspective view of the separator 50.

As illustrated in FIG. 7, a separator 50 is a cup-shaped member made of silicon resin, of which front side is open and back side is closed. The separator 50 includes an upper separator main body 52 and a lower separator main body 53.

As illustrated in FIG. 4, the upper separator main body 52 is disposed above the reference axis AX, and the lower separator main body 53 is disposed below the reference axis AX. The reference axis AX extends in the X axis direction.

A front surface 52*a* of the upper separator main body 52 is configured as a surface having an inverted shape of the upper half above the reference axis AX of a back surface 60*b* of the primary lens 60 (spherical surface which is concave in the backward direction), so that the upper half of the back surface 60*b* of the primary lens 60 (spherical surface which is convex in the backward direction) is surface-contacted.

The back surface 52*b* of the upper separator main body 52 (see FIG. 3 and FIG. 4) is configured as a surface having an inverted shape of the upper half above the reference axis AX of the front surface 42*a* of the holder 40 (holder main body 42) (spherical surface which is convex in the backward direction), so that the upper half of the front surface 42*a* of the holder 40 (holder main body 42) (spherical surface which is concave in the forward direction) is surface-contacted.

As illustrated in FIG. 8A, the lower edge of the front surface 52*a* of the upper separator main body 52 includes a stepped edge 52*a*1 having a shape corresponding to the cut-off line $CL_{Lo}$ (CL1 to CL3), and extended edge 52*a*2 and 52*a*3 which are disposed on each side of the stepped edge 52*a*1. The extended edge may be disposed only on one side.

The stepped edge 52*a*1 includes an edge e1 corresponding to the left horizontal cut-off line CL1, an edge e2 corresponding to the right horizontal cut-off line CL2, and an edge e3 corresponding to the diagonal cut-off line CL3 connecting the left horizontal cut-off line CL1 and the right horizontal cut-off line CL2.

The extended edge 52*a*2 is disposed at a same position as the edge el with respect to the Z axis direction, and the extended edge 52*a*3 is disposed at a same position of the edge e2 with respect to the Z axis direction.

A lower end face 52*c* of the upper separator main body 52 (see FIG. 4) is a surface which extends from the lower edge of the front surface 52*a* of the upper separator main body 52 toward the back surface 52*b* of the upper separator main body 52 in the horizontal direction (X axis direction).

As illustrated in FIG. 3 and FIG. 4, the first light guiding unit 52*d* is disposed on the back surface 52*b* of the upper separator main body 52, in order to guide the light from the light source module 30 (a plurality of light sources 32*a*). The base end portion of the first light guide portion 52*d* is provided in a partial region of the rear surface 52*b* of the upper separator main body 52 including the stepped edge portion 52*a*1. The first light guide 52*d* extends toward the light source module 30 (a plurality of low beam light sources 32*a*). The partial region including the stepped edge portion 52*a*1 is a region of the back surface 52*b* of the upper separator main body 52, to which the light source module 30 (light-emitting surfaces of the plurality of light sources 32*a*) faces. The first light guiding unit 52*d* is inserted into the through hole 42*c* of the holder 40.

At the front end of the first light guiding unit 52*d*, a first entry surface 52*e* is disposed. The first entry surface 52*e* is in a plane that is parallel with the plane which includes the Y axis and the Z axis, for example.

The first entry surface 52*e* is disposed at a position facing the light source module 30 (light-emitting surfaces of the plurality of light sources 32*a*) in a state where the first light guiding unit 52*d* is inserted into the through hole 42*c* of the holder 40 (see FIG. 4). The distance between the first entry surface 52*e* and the light source module 30 (light-emitting surfaces of the plurality of light sources 32*a*) is 0.2 mm, for example.

As illustrated in FIG. 5 and FIG. 7, a flange unit 52*f* is disposed on the front side end face of the upper separator main body 52. In the flange unit 52*f*, a through hole 52*f*1 (one location in FIG. 5 and FIG. 7), to which the convex portion 48 of the holder 40 is inserted, and through holes 52*f*2 (two locations in FIG. 5 and FIG. 7) to which the convex portions 49 of the holder 40 are inserted are disposed.

The front surface 53*a* of the lower separator main body 53 is configured as a surface having an inverted shape of the lower half below the reference axis AX of the back surface 60*b* of the primary lens 60 (spherical surface which is concave in the backward direction), so that the lower half of the back surface 60*b* of the primary lens 60 (spherical surface which is convex in the backward direction) is surface-contacted.

The back surface 53*b* of the lower separator main body 53 (see FIG. 3 and FIG. 4) is configured as a surface having an inverted shape of the lower half below the reference axis AX of the front surface 42*a* of the holder 40 (holder main body 42) (spherical surface which is convex in the backward direction), so that the lower half of the front surface 42*a* of the holder 40 (holder main body 42) (spherical surface which is concave in the forward direction) is surface-contacted.

As illustrated in FIG. 8B, the upper edge of the front surface 53*a* of the lower separator main body 53 includes a stepped edge 53*a*1 (edges e1' to e3') having an inverted shape of the stepped edge 52*a*1 and extended edges 53*a*2 and 53*a*3 which are disposed on each side of the stepped edge 53*a*1. The extended edge may be disposed only on one side.

The extended edge 53*a*2 is disposed at the same position as the edge e1' with respect to the Z axis direction. The extended edge 53*a*3 is disposed at the same position as the edge e2' with respect to the Z axis direction.

The upper end face 53*c* of the lower separator main body 53 (see FIG. 4) is a surface which extends from the upper edge of the front surface 53*a* of the lower separator main body 53 toward the back surface 53*b* of the lower separator main body 53 in the horizontal direction (X axis direction).

As illustrated in FIG. 3 and FIG. 4, the second light guiding unit 53*d* is disposed on the back surface 53*b* of the lower separator main body 53, in order to guide the light from the light source module 30 (a plurality of light sources 32*b*). The base end portion of the second light guide portion 53*d* is provided in a partial region of the rear surface 53*b* of the lower separator main body 53 including the stepped edge portion 53*a*1. The second light guide 53*d* extends toward the light source module 30 (a plurality of low beam light sources 32*b*). The partial region including the stepped edge portion 53*a*1 is a region of the back surface 53*b* of the lower separator main body 53, to which the light source module 30 (light-emitting surfaces of the plurality of light sources 32*b*) faces. The second light guiding unit 53*d* is inserted into the through hole 42*c* of the holder 40.

Figure 9A:
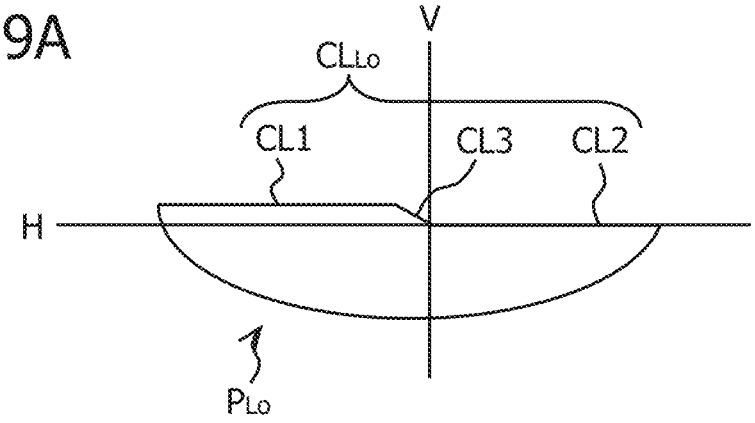
FIG. 9A is an example of low beam light distribution pattern $P_{Lo}$.
Figure 9B:
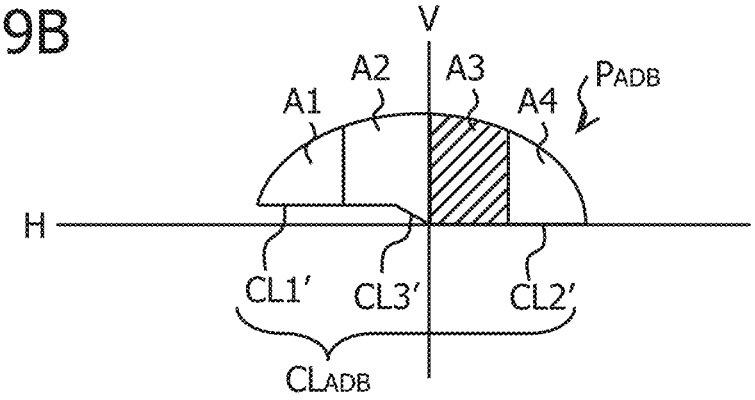
FIG. 9B is an example of ADB light distribution pattern $P_{ADB}$.

At the front end of the second light guiding unit 53*d*, a second entry surface 53*e* is disposed. The second entry surface 53*e* is a surface that is adjusted such that a plurality of regions constituting the ADB light distribution pattern (e.g. a plurality of regions A1 to A4 which are independently turned ON/OFF) are formed in a state of being divided by the vertical edges, as illustrated in FIG. 9B, preventing these plurality of regions from becoming circles and overlapping with each other, as illustrated in FIG. 9D. FIG. 9B and FIG. 9D are ADB light distribution patterns that are formed when a number of ADB light sources 32*b* is four. A hatched region in FIG. 9B and FIG. 9D is a region where the ADB light source 32*b*, corresponding to this region, is turned OFF.

The second entry surface 53*e* is disposed at a position facing the light source module 30 (light-emitting surfaces of the plurality of ADB light sources 32*b*) in a state where the second light guiding unit 53*d* is inserted into the through hole 42*c* of the holder 40 (see FIG. 4). The distance between the second entry surface 53*e* and the light source module 30 (light-emitting surfaces of the plurality of ADB light sources 32*b*) is 0.2 mm, for example.

As illustrated in FIG. 5 and FIG. 7, a flange unit 53*f* is disposed on the front side end face of the lower separator main body 53. In the flange unit 53*f*, through holes 53*f*1 (two locations in FIG. 5 and FIG. 7) to which the convex portions 48 of the holder 40 are inserted are disposed.

In the lower separator main body 53, a notch S5 is formed so that the connector 34*c* of the light source module 30 does not contact (interfere) with the lower separator main body 53.

As illustrated in FIG. 8C, the upper separator main body 52 and the lower separator main body 53 are combined and constitute the separator 50, in a state where the bottom edge of the front surface 52*a* of the upper separator main body 52 and the top edge of the front surface 53*a* of the lower separator main body 53 are line-contacted, and the lower end face 52*c* of the upper separator main body 52 and the upper end face 53*c* of the lower separator main body 53 are surface-contacted.

The separator 50 having the above configuration is disposed in a state where the first light guiding unit 52*d* of the upper separator main body 52 and the second light guiding unit 53*d* of the lower separator main body 53 are inserted (e.g. press-fitted or engaged) into the through holes 42*c* of the holder 40, the first entry surface 52*e* of the upper separator main body 52 (first light guiding unit 52*d*) and the light source module 30 (light-emitting surfaces of the plurality of low beam light sources 32*a*) face each other, the second entry surface 53*e* of the lower separator main body 53 (second light guiding unit 53*d*) and the light source module 30 (light-emitting surfaces of the plurality of the ADB light sources 32*b*) face each other (see FIG. 3 and FIG. 4), and the back surface of the separator 50 (back surface 52*b* of the upper separator main body 52 and the back surface 53*b* of the lower separator main body 53) is surface-contacted with the front surface 42*a* of the holder 40 (holder main body 42) (see FIG. 3 and FIG. 4).

Here the convex portions 48 of the holder 40 are inserted into the through hole 52*f*1 of the upper separator main body 52 and the through holes 53*f*1 of the lower separator main body 53 (see FIG. 6). Further, the convex portion 49 of the holder 40 is inserted into the through holes 52*f*2 of the upper separator main body 52 (see FIG. 6).

As illustrated in FIG. 5, the primary lens 60 is a spherical lens which includes the front surface 60*a* and the back surface 60*b* on the opposite side of the front surface 60*a*. The front surface 60*a* is a spherical surface which is convex in the forward direction, and the back surface 60*b* is a spherical surface which is convex in the backward direction. The flange unit 62 is disposed in the primary lens 60. The flange unit 62 extends between the front surface 60*a* and the back surface 60*b* so as to surround the reference axis AX.

As illustrated in FIG. 5, the retainer 70 is made of synthetic resin (e.g. acrylic and polycarbonate), and includes a retainer main body 72, which is a tubular body which conically widens from the front side opening end face to the rear side opening end face.

As illustrated in FIG. 5, the secondary lens 80 is made of synthetic resin (e.g. acrylic and polycarbonate), and includes a lens main body 82.

The lens main body 82 includes a front surface 82*a* and a back surface 82*b* on the opposite side of the front surface 82*a* (see FIG. 3 and FIG. 4). The front surface 82*a* is a plane that is parallel with the plane which includes the Y axis and Z axis, and the back surface 82*b* is a spherical surface which is convex in the backward direction.

On the outer periphery of the lens main body 82, a tubular unit 84, which extends from the outer periphery of the lens main body 82 in the backward direction (X axis direction), is disposed.

The primary lens 60 and the secondary lens 80 constitute the projection lens of which focal point F (see FIG. 8C) is located in the vicinity of the lower edge (stepped edge 52*a*1) of the front surface 52*a* of the upper separator main body 52 and the upper edge (stepped edge 53*a*1) of the front surface 53*a* of the lower separator main body 53. The curvature of field (rear focal plane) of this projection lens approximately matches the lower edge (stepped edge 52*a*1) of the front surface 52*a* of the upper separator main body 52 and the upper edge (stepped edge 53*a*1) of the front surface 53*a* of the lower separator main body 53.

For the primary lens 60 and the secondary lens 80 constituting this projection lens, the spherical lens and the plano-convex lens according to Japanese Patent Application Publication No. 2015-79660, for example, can be used.

The secondary lens 80 having the above configuration is disposed in a state where the lens main body 82 is disposed ahead of the primary lens 60; and the pressor/screw receiving unit 86 is in contact with the flange unit 76 of the retainer 70 (see FIG. 3 and FIG. 4).

In the case of the vehicular lamp fitting 10 having the above configuration, when the plurality of low beam light sources 32*a* are turned ON, the lights from the plurality of low beam light sources 32*a* enter through the first entry surface 52*e* of the first light guiding unit 52*d* of the upper separator main body 52, are guided inside the first light guiding unit 52*d*, and exit through the front surface 52*a* of the upper separator main body 52. Thereby a luminous intensity distribution corresponding to the low beam light distribution pattern is formed on the front surface 52*a* of the upper separator main body 52. This luminous intensity distribution includes the edges e1 to e3 (see FIG. 8A) corresponding to the cut-off line $CL_{Lo}$ (CL1 to CL3). The projection lens constituted by the primary lens 60 and the secondary lens 80 inversely projects forward this light intensity distribution. Thereby the low beam light distribution pattern $P_{Lo}$, which includes the cut-off line CL (CL1 to CL3) at the upper edge, is formed, as illustrated in FIG. 9A.

When the plurality of ADB light sources 32*b* are turned ON, the lights from the plurality of ADB light sources 32*b* enter through the second entry surface 53*e* of the second light guiding unit 53*d* of the lower separator main body 53, are guided inside the second light guiding unit 53*d*, and exit through the front surface 53*a* of the lower separator main body 53. Thereby a luminous intensity distribution corresponding to the ADB light distribution pattern is formed on the front surface 53*a* of the lower separator main body 53. This luminous intensity distribution includes the edges e1' to e3' (see FIG. 8B) corresponding to the cut-off line $CL_{ADB}$ (CL1' to CL3'). The projection lens constituted by the primary lens 60 and the secondary lens 80 inversely projects forward the light intensity distribution. Thereby the ADB light distribution pattern $P_{ADB}$, which includes the cut-off line $CL_{ADB}$ (CL1' to CL3') in the lower edge, is formed, as illustrated in FIG. 9B. FIG. 9B indicates the ADB light distribution pattern $P_{ADB}$ which is formed when a number of ADB light sources 32*b* is four. The hatched region in FIG. 9B indicates that the ADB light source 32*b*, corresponding to this region, is turned OFF.

Figure 9C:
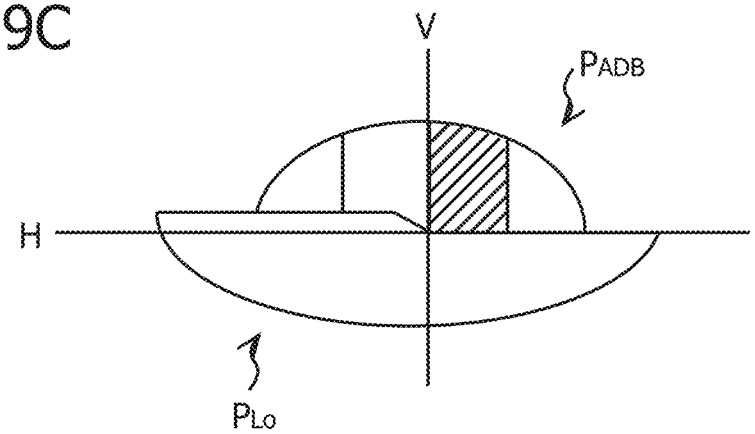
FIG. 9C is an example of a composite light distribution pattern which includes a low beam light distribution pattern $P_{Lo}$ and an ADB light distribution pattern $P_{ADB}$.
Figure 9D:
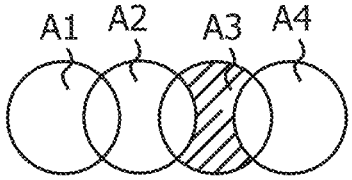
FIG. 9D is a diagram showing a state in which a plurality of regions (for example, a plurality of regions A1 to A4 individually turned on and off) constituting the ADB light distribution pattern are circularly overlapped.

When the plurality of low beam light sources 32*a* and the plurality of ADB light sources 32*b* turn ON, a composite light distribution pattern, including the low beam light distribution pattern $P_{Lo}$ and the ADB light distribution pattern $P_{ADB}$, is formed, as illustrated in FIG. 9C.

According to the study by the present inventors, in the case of the vehicular lamp fitting 10 having the above configuration, the regulations specified for the low beam distribution pattern are satisfied, but the luminous intensity of a part of the low beam light distribution pattern (e.g. area around 4° below the horizontal line) becomes relatively high, and luminous intensity unevenness (brightness unevenness) is generated, and as a result, the naturalness of the light distribution is diminished.

A part of the low beam light distribution pattern (e.g. area around 4° below the horizontal line) becomes high because light, of which luminous intensity is relatively strong (e.g. light in the narrow angle direction with respect to the optical axis $AX_{32a}$ of the low beam light source 32*a* (see FIG. 4)), out of the light from the low beam light source 32*a* is projected to a part of the low beam light distribution pattern $P_{Lo}$ (e.g. area around 4° below the horizontal line) by the projection lens constituted by the primary lens 60 and the secondary lens 80.

Figure 10:
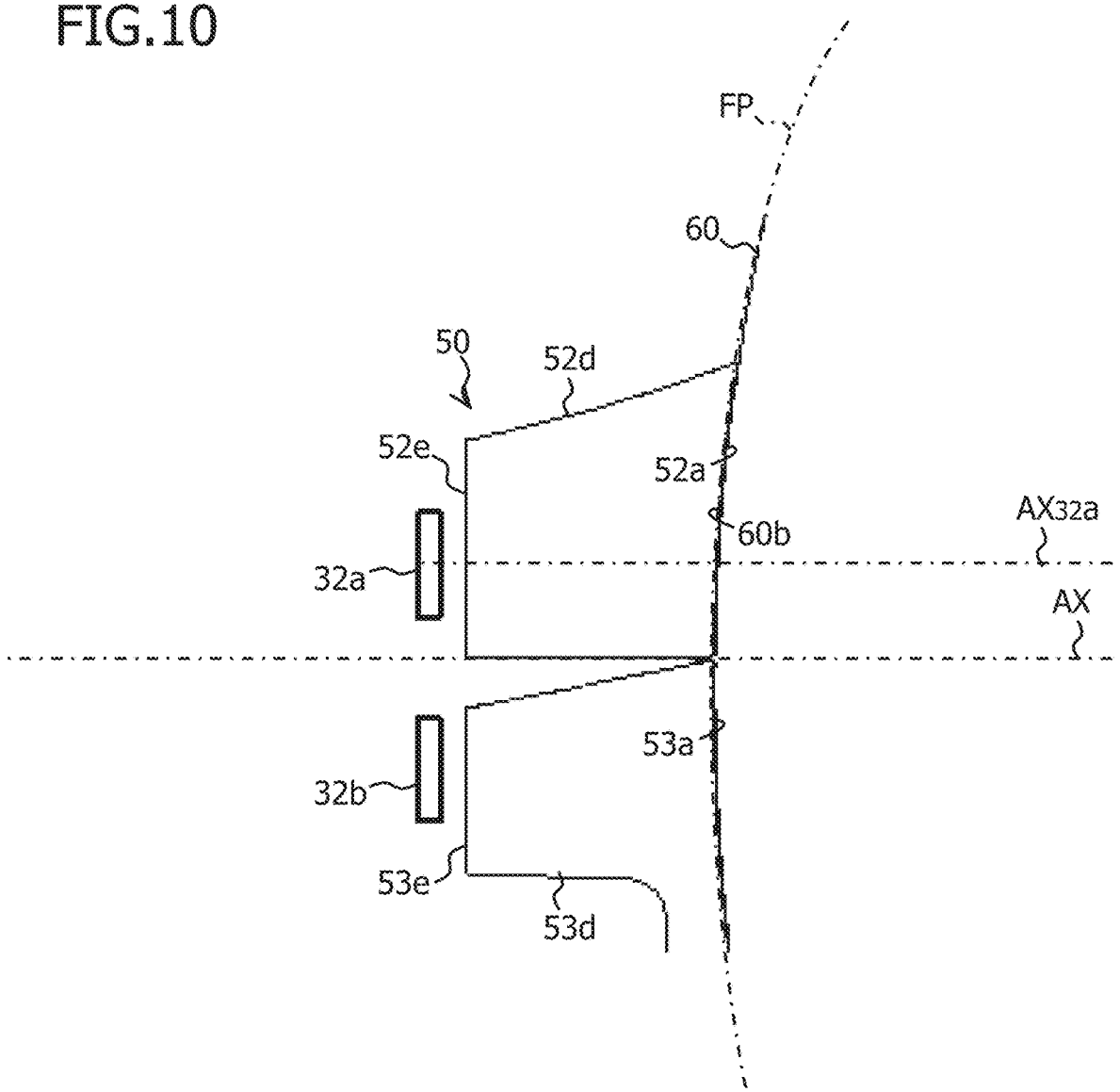
FIG. 10 is an example of using a separator which includes only the first light guiding unit 52*d* (light guiding lens the same as the above mentioned prior art), omitting the upper separator main body 52.

FIG. 10 is an example of using a separator which includes only the first light guiding unit 52*d* (light guiding lens the same as the above mentioned prior art), omitting the upper separator main body 52.

Figure 11:
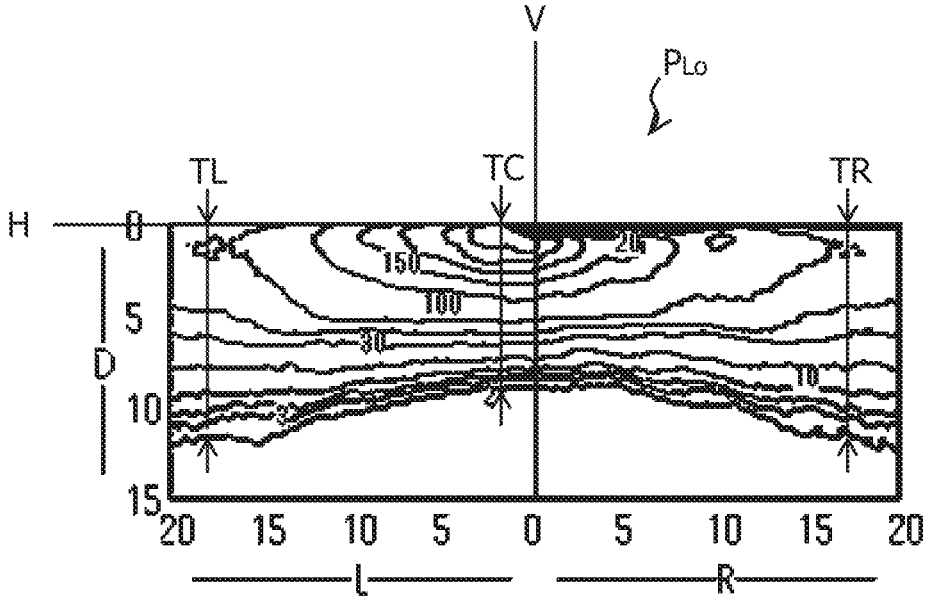
FIG. 11 is an example of the low beam light distribution pattern $P_{Lo}$, that is formed when the separator which includes only the first light guiding unit 52*d* is used, omitting the upper separator main body 52.

As shown in FIG. 10, when the upper separator main body 52 is omitted and the separator of only the first light guide 52*d* is used as the separator 50, the following is found. First, the luminous intensity of a part of the low beam light distribution pattern $P_{Lo}$ (e.g. area around 4° below the horizontal line) becomes relatively high. Second, as shown in FIG. 11, the thickness TC at the center portion of the low beam light distribution pattern $P_{Lo}$ becomes thinner than the thicknesses TL and TR on the left and right sides. Third, as a result, the light distribution feeling is reduced.

The specific reason as to why the thickness TC at the center portion of the low beam light distribution pattern $P_{Lo}$ becomes thinner than the thicknesses TL and TR on the left and right sides thereof, is unknown, but the following may be possible.

A reason may be because, firstly, the thickness of the upper separator main body 52 along the reference axis AX becomes thicker in the horizontal direction as departing from the reference axis AX (see thicknesses T1 and T2 in FIG. 3). Secondly, the optical path length in the upper separator main body 52 is longer as the light from the low beam light source 32*a* passes through the thicker portion of the upper separator main body 52. Hence the light that passes through this portion is diffused considerably in the vertical direction, and exits through the front surface 52*a* of the upper separator main body 52.

For example, a portion of the upper separator main body 52 that is distant from the reference axis AX (e.g. portion at thickness T2 in FIG. 3) is thicker than a portion that is closer to the reference axis AX (e.g. portion at thickness T1 in FIG. 3). Therefore, in the upper separator main body 52, the optical path length of the of the light from the low beam light source 32*a* passing through the portion that is distant from the reference axis AX (e.g. portion at thickness T2 in FIG. 3) is longer than that of the light from the low beam light source 32*a* passing through the portion that is closer to the reference axis AX (e.g. portion at the thickness T1 in FIG. 3). Hence the light from the low beam light source 32*a* passing through the portion that is distant from the reference axis AX is considerably diffused in the vertical direction, and exits through the front surface 52*a* of the upper separator main body 52. As a result, the thickness TC at the center portion of the low beam light distribution pattern $P_{Lo}$ becomes thinner than the thicknesses TL and TR on the left and right thereof.

Figure 19A:
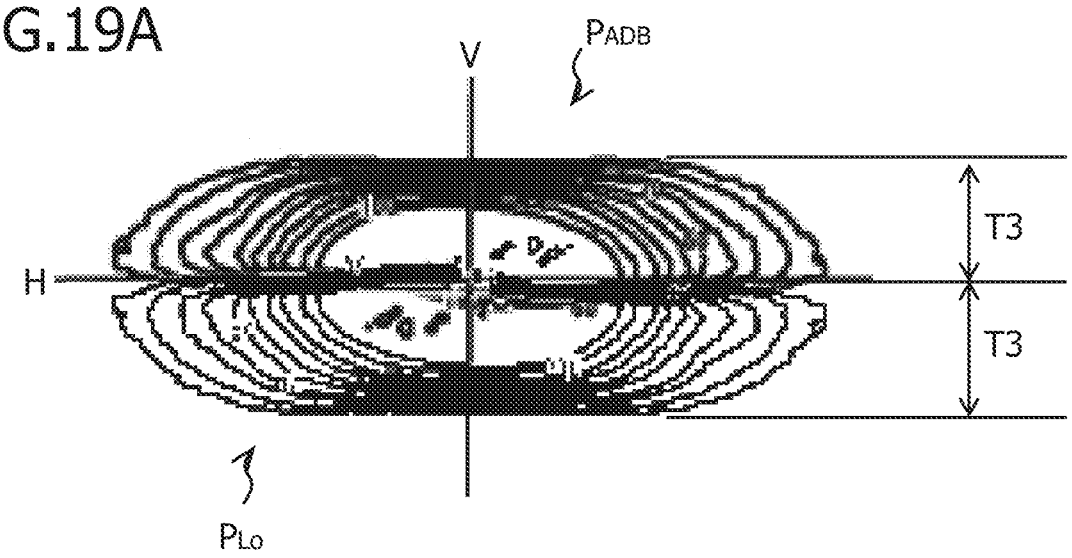
FIG. 19A is an example of a ADB light distribution pattern and a low beam light distribution pattern formed when the separator shown in FIG. 10 (light guiding lens similar to the above-mentioned prior art) is used.

According to the study by the present inventors, the low beam light distribution is demanded that the length in the vertical direction is longer, the density is lower (brightness range is smaller) and the maximum luminous intensity is lower, compared with the ADB light distribution pattern, but the low beam light distribution pattern that is demanded is not formed in the cases when: the focal plane FP of the projection lens 90 and the front surface 52*a* of the separator 50, through which the light from the low beam light source 32*a* exits (and the back surface 60*b* of the primary lens 60 through which the light from the low beam light source 32*a*, which exited through the front surface 52*a* of the separator 50, enters), are both spherical surfaces (spherical surfaces of which curvature is constant) and match (surface-contacted); and the focal plane FP of the projection lens 90 and the front surface 53*a* of the separator 50 through which the light from the ADB light source 32*b* exits (and the back surface 60*b* of the primary lens 60 through which the light from the ADB light source 32*b*, which exited through the front surface 53*a* of the separator 50, enters), are both spherical surfaces (spherical surfaces of which curvature is constant) and match (surface-contacted), as illustrated in FIG. 10, because the low beam light distribution pattern $P_{Lo}$ and the ADB light distribution pattern $P_{ADB}$ have vertically symmetric shapes and luminous intensity distribution, as illustrated in FIG. 19A. Further, in this case, the contour of the ADB light distribution pattern becomes clearer and the naturalness of the light distribution is diminished. FIG. 19A is an example of the ADB light distribution pattern and the low beam light distribution pattern which are formed when the separator illustrated in FIG. 10 (light guiding lens the same as the above mentioned prior art) is used.

Now as Embodiment 2, a vehicular lamp fitting 10A which forms: a low beam light distribution pattern of which length in the vertical direction is longer, density is lower (brightness range is smaller) and maximum luminous intensity is lower compared with an ADB light distribution pattern; and an ADB light distribution pattern of which contour is moderately blurred, will be described.

The differences of the vehicular lamp fitting 10A of the present embodiment from the above mentioned vehicular lamp fitting 10 of Embodiment 1 are: a separator 50A is used instead of the separator 50; and a primary lens 60A is used instead of the primary lens 60. The rest of the configuration is the same as Embodiment 1. In the following, the differences from Embodiment 1 will be primarily described, and a composing element the same as Embodiment 1 is denoted with the same reference sign, and description thereof may be omitted.

Figure 12:
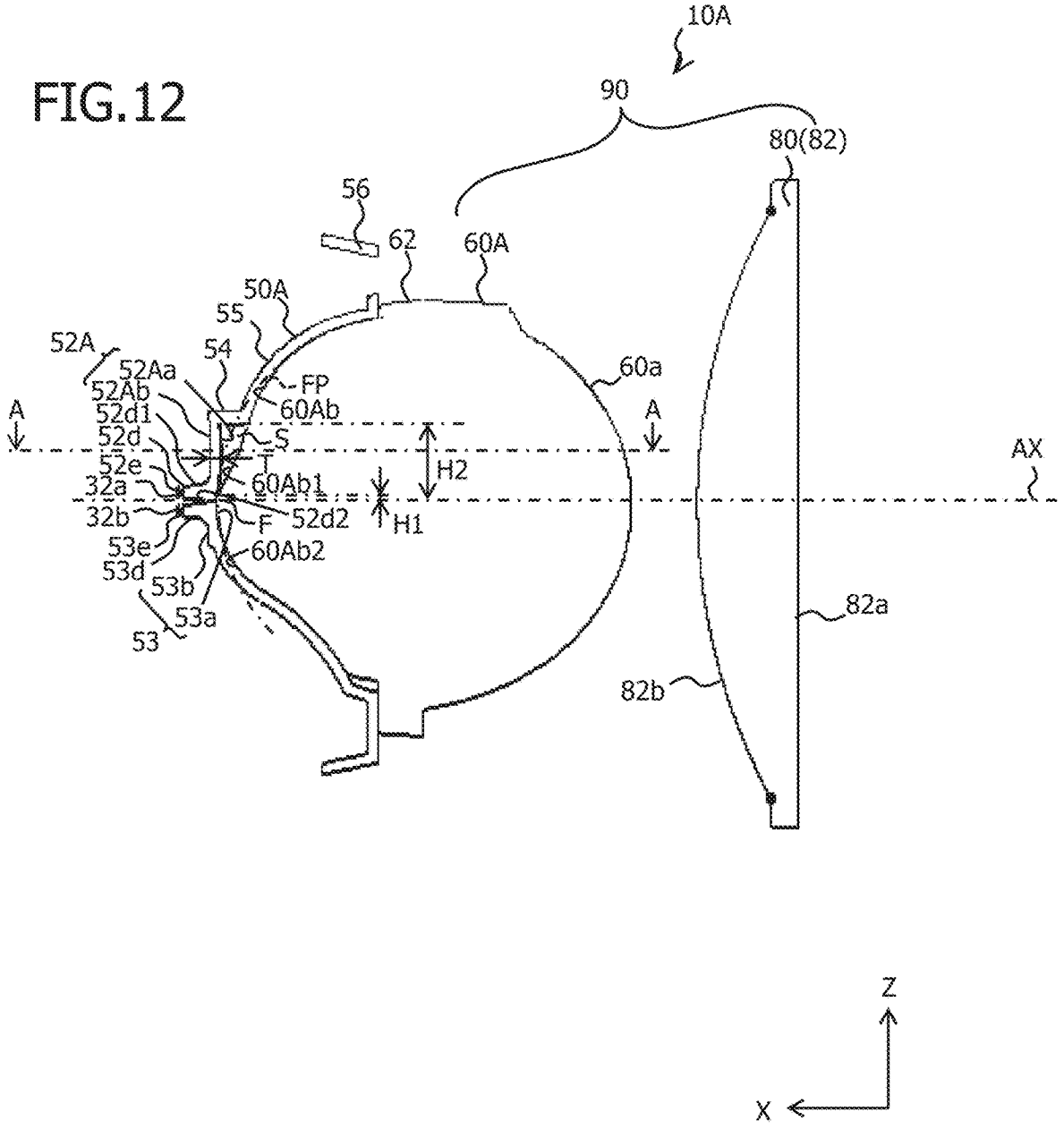
FIG. 12 is a cross-sectional view of the vehicular lamp fitting 10A sectioned at the vertical plane, including the reference axis AX (plane including the X axis and Z axis).
Figure 13:
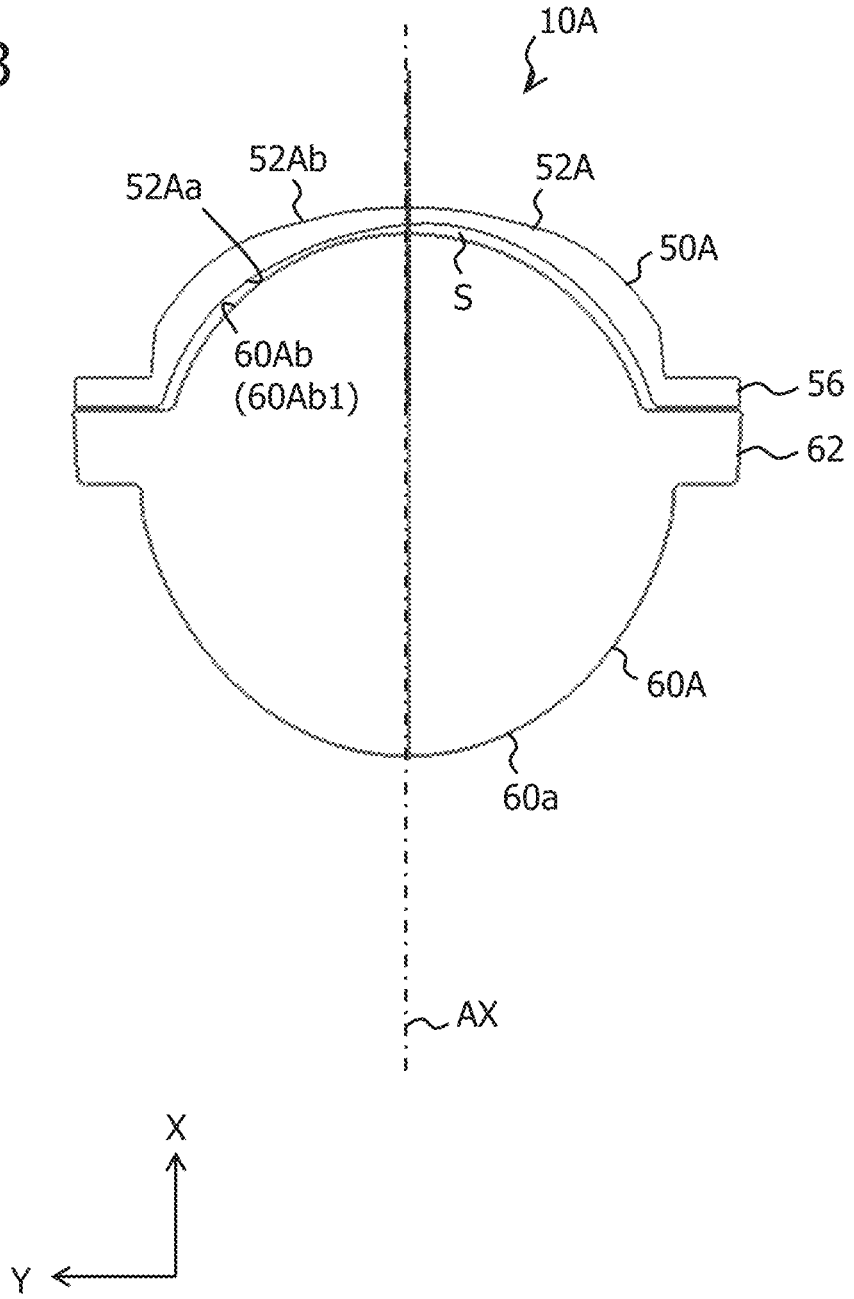
FIG. 13 is a cross-sectional view of the vehicular lamp fitting 10A sectioned at A-A in FIG. 12.

FIG. 12 is a cross-sectional view of the vehicular lamp fitting 10A sectioned at the vertical plane, including the reference axis AX (plane including the X axis and Z axis). FIG. 13 is a cross-sectional view of the vehicular lamp fitting 10A sectioned at A-A in FIG. 12. In FIG. 12 and FIG. 13, the heat sink 20, the holder 40, the retainer 70 and the like are omitted.

As illustrated in FIG. 12 and FIG. 13, the vehicular lamp fitting 10A includes: a secondary lens 80, a primary lens 60A disposed behind the secondary lens 80, a separator 50A disposed behind the primary lens 60A, a plurality of low beam light sources 32*a* (hereafter simply called low beam light source 32*a*) which are disposed behind the separator 50A, and which emit light that passes through the separator 50A, the primary lens 60A and the secondary lens 80 in sequence and is irradiated forward to form a low beam light distribution pattern; and a plurality of ADB light sources 32*b* (hereafter simply called ADB light source 32*b*) which emit light that passes through the separator 50A, the primary lens 60A and the secondary lens 80 in sequence and is irradiated forward to form an ADB light distribution pattern.

Similarly to Embodiment 1, the low beam light source 32*a*, the ADB light source 32*b*, the separator 50A, the primary lens 60A and the secondary lens 80 are maintained in a positional relationship illustrated in FIG. 12 by being held by the heat sink 20, the holder 40, the retainer 70 and the like.

The secondary lens 80 (front surface 82*a* and back surface 82*b*) and the primary lens 60A (front surface 60*a*) constitute the projection lens 90. In concrete terms, out of one or more lenses (primary lens 60A and secondary lens 80 in the present embodiment), optical surfaces other than the back surface of the lens disposed last (the back surface 60Ab of the primary lens 60A in the present embodiment), that is, the front surface 60*a* of the primary lens 60A and the front surface 82*a* and the back surface 82*b* of the secondary lens 80 in Embodiment 2, constitute the projection lens 90. The focal plane FP of the projection lens 90 is a spherical surface of which curvature is constant, for example (see FIG. 20).

As illustrated in FIG. 12, the focal point F of the projection lens 90 is located between the lower edge of the front surface 52Aa of the upper separator main body 52A and the upper edge of the front surface 53*a* of the lower separator main body 53 with respect to the vertical direction. Further, although not illustrated, the focal point F of the projection lens 90 is located at the center of the lower edge of the front surface 52Aa of the upper separator main body 52A (and the upper edge of the front surface 53*a* of the lower separator main body 53) with respect to the horizontal direction. The reference axis AX passes through the focal point F, and extends in the longitudinal direction of the vehicle (X direction).

Figure 14:
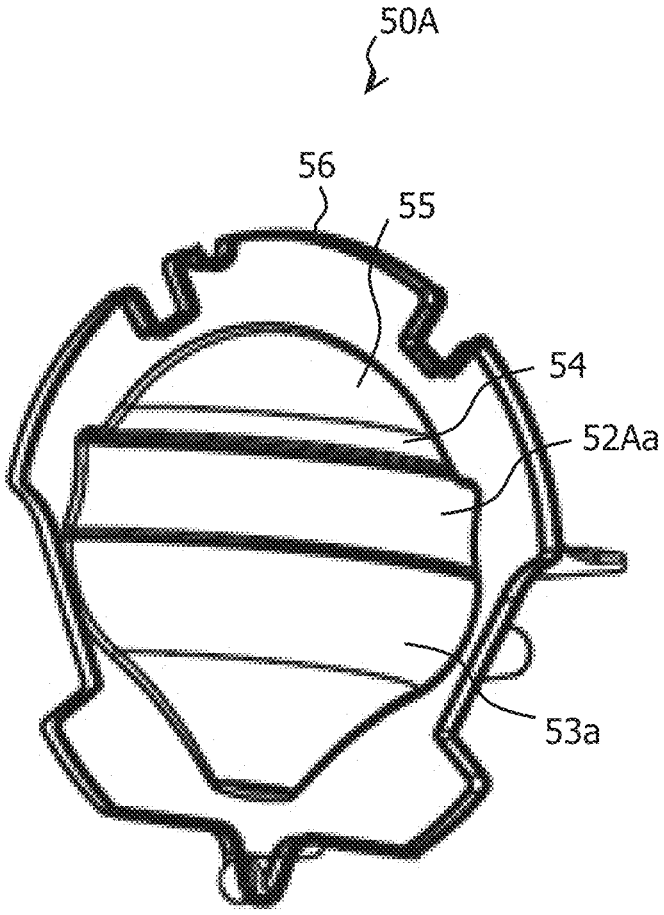
FIG. 14 is a perspective view of the separator 50A.
Figure 15A:
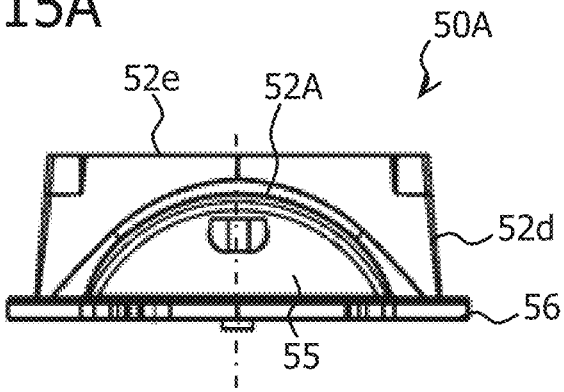
FIG. 15A is a top view.
Figure 15D:
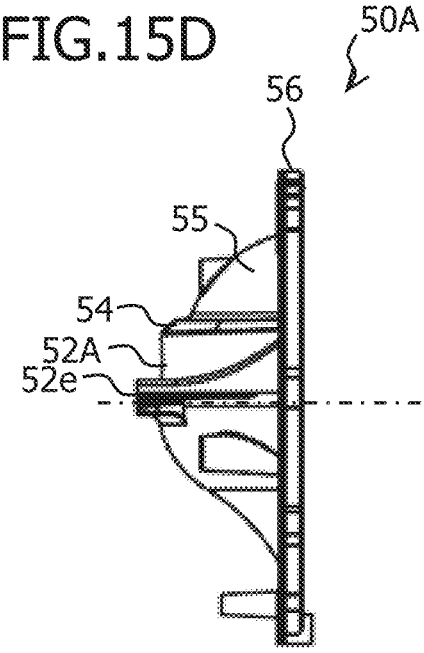
FIG. 15D is a side view of the separator 50A.
Figure 15B:
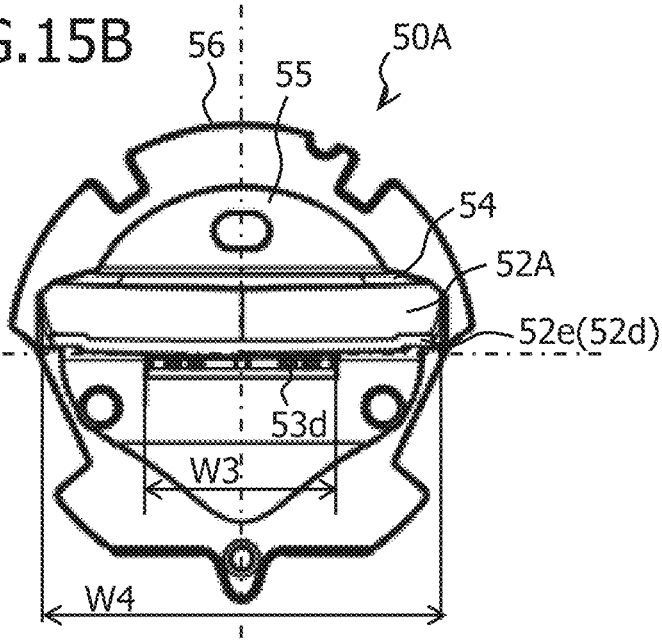
FIG. 15B is a rear view.
Figure 15C:
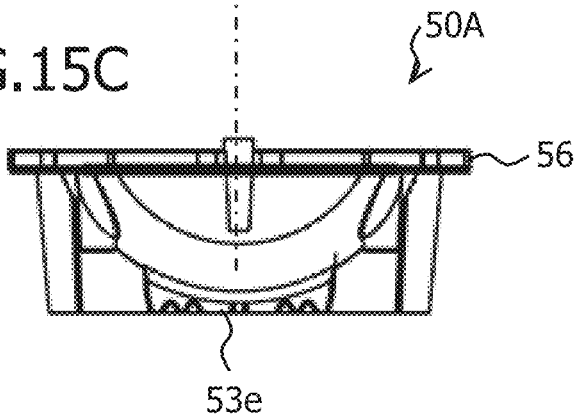
FIG. 15C is a bottom view.

FIG. 14 is a perspective view of the separator 50A. FIG. 15A is a top view, FIG. 15B is a rear view, FIG. 15C is a bottom view, and FIG. 15D is a side view of the separator 50A.

The separator 50A is a cup-shaped member which is made of silicon resin, and of which front side is open and back side is closed, as illustrated in FIG. 14.

As illustrated in FIG. 12, the separator 50A includes an upper separator main body 52A, a first light guiding unit 52*d*, a first extending unit 54, a second extending unit 55, a lower separator main body 53, a second light guiding unit 53*d* and a flange unit 56, and these units are integrally molded as one component.

The upper separator main body 52A is disposed above the reference axis AX, and the lower separator main body 53 is disposed below the reference axis AX.

The upper separator main body 52A is a thin plate type light guiding unit which includes the front surface 52Aa and the back surface 52Ab on the opposite side of the front surface 52Aa. In concrete terms, in the horizontal cross-sectioned view, the upper separator main body 52A, which is a thin plate type light guiding unit, curves along the back surface 60Ab (upper entry surface 60Ab1) of the primary lens 60A (see FIG. 13), and, in the vertical cross-sectional view, extends upward (see FIG. 12). The lower edge of the front surface 52Aa of the upper separator main body 52A includes a stepped edge 52*a*1 (not illustrated in FIG. 12), having a shape corresponding to the cut-off line $CL_{Lo}$ (CL1 to CL3), similarly to Embodiment 1.

As illustrated in FIG. 12, the upper separator main body 52A is disposed in a state where the front surface 52Aa faces the back surface 60Ab (upper entry surface 60Ab1) of the primary lens 60A.

The lower portion of the front surface 52Aa of the upper separator main body 52A is surface-contacted with the lower portion of the back surface 60Ab (upper entry surface 60Ab1) of the primary lens 60A. Further, the space S is formed between a portion above the lower portion of the front surface 52Aa of the upper separator main body 52A and a portion above the lower portion of the back surface 60Ab (upper entry surface 60Ab1) of the primary lens 60A.

The interval (space S) between the front surface 52Aa of the upper separator main body 52A and the back surface 60Ab (upper entry surface 60Ab1) of the primary lens 60A increases in the upward direction. The relationship between the front surface 52Aa of the upper separator main body 52A and the rear focal plane FP of the projection lens 90 (curvature of field, see FIG. 12) is also the same.

The light from the low beam light source 32*a*, which exits through the first light guiding unit 52*d* (front surface 52Aa) of the upper separator main body 52A, becomes diffused light, hence the light that reaches the back surface 60Ab (upper entry surface 60Ab1) of the primary lens 60A becomes weaker as the distance (space S) between the front surface 52Aa of the upper separator main body 52A and the back surface 60Ab (upper entry surface 60Ab1) of the primary lens 60A increases (that is, in the upward direction from the reference axis AX). As a result, the low beam light distribution pattern has an ideal luminous intensity distribution which gradually decreases in the downward direction from the upper edge.

A length H1 in the vertical direction (see FIG. 12) of the portion, where the lower portion of the front surface 52Aa of the upper separator main body 52A and the lower portion of the back surface 60*b* (upper entry surface 60Ab1) of the primary lens 60A are surface-contacted (surface-contacted portion), is 0.7 mm, for example. By disposing this surface-contacted portion, a high luminous intensity zone, where the luminous intensity is relatively high, can be formed in the vicinity of the cut-off line of the low beam light distribution pattern. Further, by adjusting the length H1, the length of the high luminous intensity band in the vertical direction can be adjusted.

The front surface 52Aa of the upper separator main body 52A is formed as a curved surface which is slightly convex in the forward direction, for example (see FIG. 17), so that the light from the low beam light source 32*a*, which is guided through the upper separator main body 52A while repeating the total reflection between the front surface 52Aa of the upper separator main body 52A and the back surface 52Ab thereof, exits through the front surface 52Aa of the upper separator main body 52A. In the same manner, the back surface 52Ab of the upper separator main body 52A also is formed as a curved surface which is slightly convex in the forward direction.

The thickness T of the upper separator main body 52A (see FIG. 12) is 2 mm, for example, considering moldability. The length H2 of the upper separator main body 52A in the vertical direction (see FIG. 12) is 7 mm, for example, considering the length (thickness) of the low beam light distribution pattern in the vertical direction. By adjusting the length H2, the length of the low beam light distribution pattern in the vertical direction can be adjusted.

As illustrated in FIG. 12, the first light guiding unit 52*d* is a thin plate type light guiding unit which includes the upper surface 52*d*1 and the lower surface 52*d*2 on the opposite side of the upper surface 52*d*1. The first light guiding unit 52*d* extends from the lower portion of the upper separator main body 52A (back surface 52Ab) toward the low beam light source 32*a*, and, at the front end, has a first entry surface 52*e* which faces the low beam light source 32*a*. The first entry surface 52*e* is a surface through which the light from the low beam light source 32*a* enters the separator 50A (first light guiding unit 52*d*), and is a plane that is parallel with the plane including the Y axis and the Z axis, for example.

The first extending unit 54 and the second extending unit 55 are connecting portions which have no optical function. The first extending unit 54 extends forward from the upper end portion of the upper separator main body 52A. The second extending unit 55 extends along the back surface 60Ab of the primary lens 60A, from the front end portion of the first extending unit 54.

The lower separator main body 53 is a thin plate type light guiding unit which includes the front surface 53*a* and the back surface 53*b* on the opposite side of the front surface 53*a*. The upper edge of the front surface 53*a* of the lower separator main body 53 includes the stepped edge 53*a*1 (not illustrated in FIG. 12) having an inverted shape of the stepped edge 52*a*1, similarly to Embodiment 1.

The second light guiding unit 53*d* extends toward the ADB light source 32*b* from the upper portion of the lower separator main body 53 (back surface 53*b*), and, at the front end, has a second entry surface 53*e* which faces the ADB light source 32*b*. The second entry surface 53*e* is a surface through which the light from the ADB light source 32*b* enters the separator 50A (second light guiding unit 53*d*), and is a plane that is parallel with the plane including the Y axis and the Z axis, for example.

Figure 16:
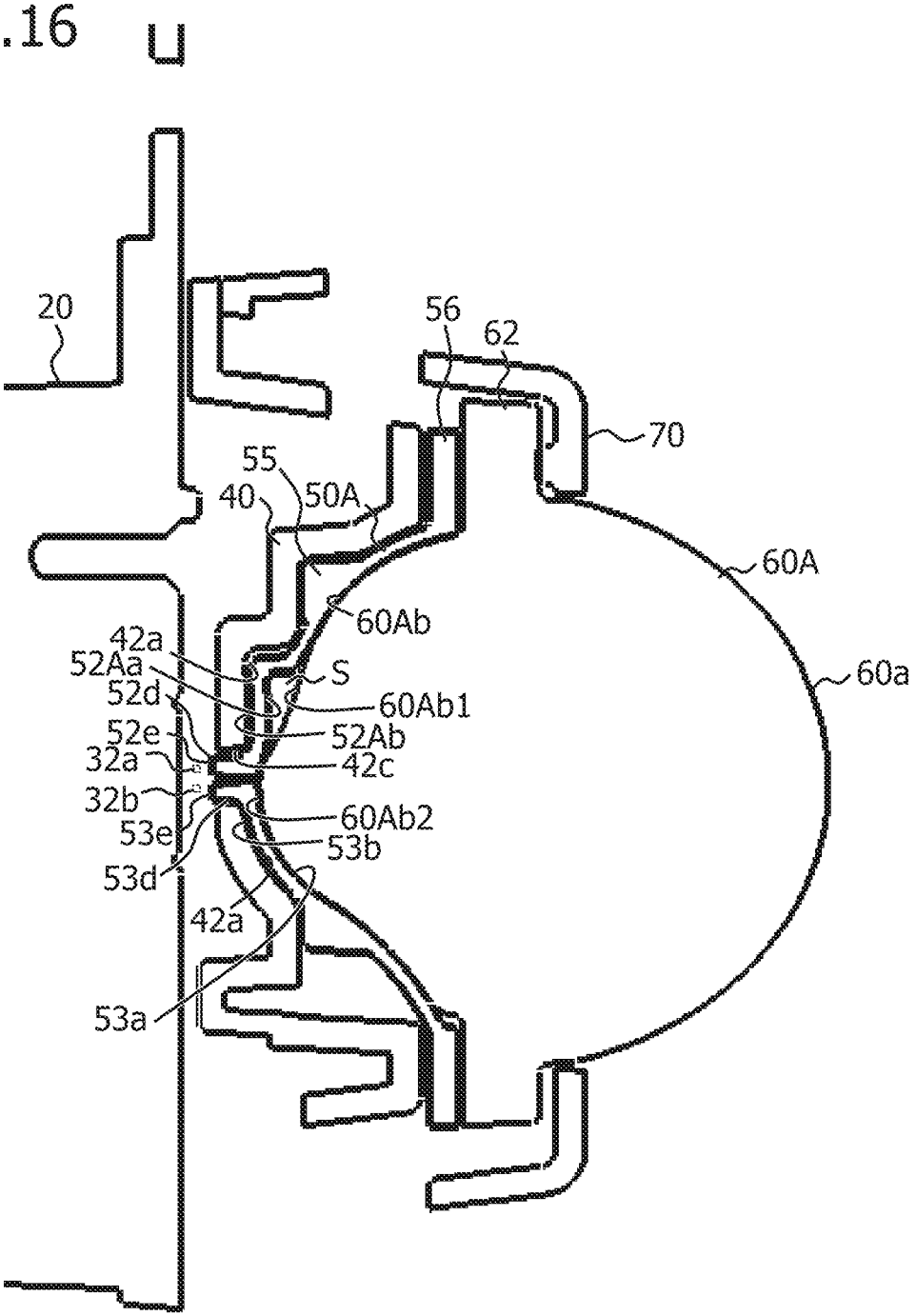
FIG. 16 is an example of a holding structure of the separator 50A and the primary lens 60A.

FIG. 16 is an example of a holding structure of the separator 50A and the primary lens 60A.

As illustrated in FIG. 16, the separator 50A having the above mentioned configuration is held with the primary lens 60A between the holder 40 and the retainer 70. In concrete terms, the first light guiding unit 52*d* and the second light guiding unit 53*d* are inserted into a through hole 42*c* of the holder 40, and are held with the primary lens 60A between the holder 40 and the retainer 70 in a state where the first entry surface 52*e* faces the low beam light source 32*a* (light-emitting surface), the second entry surface 53*e* faces the ADB light source 32*b* (light-emitting surface), and the back surface (back surface 52Ab, 53*b*) of the separator 50A is surface-contacted with the front surface 42*a* of the holder 40 (holder main body 42).

The primary lens 60A is made of transparent resin, such as acrylic and polycarbonate, and is a spherical lens including the front surface 60*a* and the back surface 60Ab on the opposite side of the front surface 60*a*, as illustrated in FIG. 12. The front surface 60*a* is a spherical surface which is convex in the forward direction, and the back surface 60Ab is a spherical surface which is convex in the backward direction. The flange unit 62 is disposed in the primary lens 60A. The flange unit 62 extends so as to surround the reference axis AX between the front surface 60*a* and the back surface 60Ab.

The back surface 60Ab of the primary lens 60A includes the upper entry surface 60Ab1 which is disposed above the reference axis AX and the lower entry surface 60Ab2 which is disposed below the reference axis AX.

The upper entry surface 60Ab1 is a surface through which the light from the low beam light source 32*a*, which exits through the front surface 52Aa of the upper separator main body 52A, enters the primary lens 60A. The upper entry surface 60Ab1 is disposed in a region facing the front surface 52Aa of the upper separator main body 52A, out of the back surface 60Ab of the primary lens 60A.

The lower portion of the upper entry surface 60Ab1 matches with the rear focal plane FP of the projection lens 90. The portion above the lower portion of the upper entry surface 60Ab1, however, does not match with the rear focal plane FP of the projection lens 90, and is inclined forward from the rear focal plane FP.

The surface shape of the upper entry surface 60Ab1 is adjusted so as to: satisfy the regulations specified for the low beam light distribution pattern; suppress the luminous intensity of a part of the low beam light distribution pattern (e.g. area around 4° below the horizontal line) from becoming relatively high; and make the thickness in the vertical direction uniform with respect to the horizontal direction (that is, suppress the diminishing of the naturalness of the light distribution). For example, the surface shape of the upper entry surface 60Ab1 is adjusted such that the luminous intensity distribution of the low beam light distribution pattern gradually decreases in a downward direction from the upper edge of the low beam light distribution pattern. In some cases, the surface shape of the front surface 52Aa of the upper separator main body 52A may be adjusted in the same manner. In this description, "uniform" is not limited to the meaning of uniform in the strict sense. In other words, "uniform" includes a state of being visually uniform or being approximately uniform.

The surface shape of the upper entry surface 60Ab1 adjusted like this becomes a complicated free form surface, hence it is difficult to express the surface shape of the upper entry surface 60Ab1 by concrete numeric values.

However, by adjusting the surface shape of the upper entry surface 60Ab1 using predetermined simulation software, and confirming the low beam light distribution pattern (e.g. luminous intensity distribution) each time adjustment is performed, it becomes possible to discern a surface shape of the upper entry surface 60Ab1 to form a low beam distribution pattern which: satisfies the regulations specified for the low beam light distribution pattern; suppresses the luminous intensity of a part of the low beam light distribution pattern (e.g. area around 4° below the horizontal line) from becoming relatively high; and makes the thickness in the vertical direction uniform with respect to the horizontal direction (that is, suppresses the diminishing of the naturalness of the light distribution).

The lower entry surface 60Ab2 is a surface through which the light from the ADB light source 32*b*, which exits through the front surface 53*a* of the lower separator main body 53, enters the primary lens 60A. The lower entry surface 60Ab2 is disposed in a region facing the front surface 53*a* of the lower separator main body 53, out of the back surface 60Ab of the primary lens 60A. The lower entry surface 60Ab2 matches with the rear focal plane FP of the projection lens 90.

As illustrated in FIG. 16, the primary lens 60A having the above configuration is held with the separator 50A between the holder 40 and the retainer 70. In concrete terms, the flange unit 62 contacts the flange unit 56 of the separator 50A, a part of the back surface 60Ab is surface-contacted with the second extending unit 55 of the separator 50A, and the lower portion of the back surface 60Ab (upper entry surface 60Ab1) surface-contacts with the lower portion of the front surface 52Aa of the upper separator main body 52A, the back surface 60Ab (lower entry surface 60Ab2) surface-contacts with the front surface 53*a* of the lower separator main body 53, and is held with the separator 50A between the holder 40 and the retainer 70 in a state where the space S is formed between the front surface 52Aa of the upper separator main body 52 and the back surface 60Ab (upper entry surface 60Ab1) of the primary lens 60A.

Figure 20:
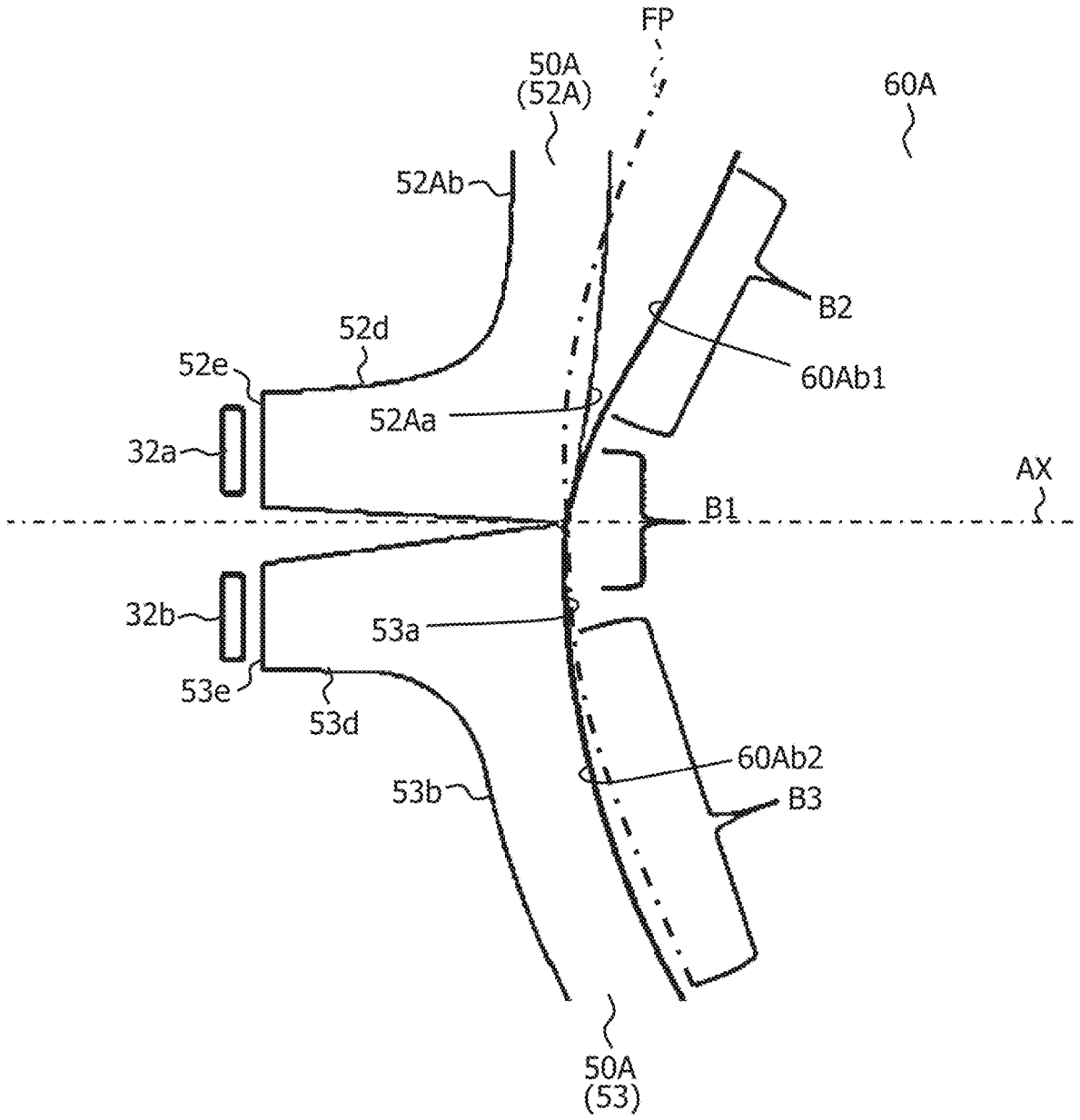
FIG. 20 is a diagram for describing the relationship between the upper entry surface 60Ab1 and the lower entry surface 60Ab2 of the primary lens 60A and the focal plane FP of the projection lens 90.

FIG. 20 is a diagram for describing the relationship between the upper entry surface 60Ab1 and the lower entry surface 60Ab2 of the primary lens 60A and the focal plane FP of the projection lens 90.

As illustrated in FIG. 20, when it is assumed that the lower portion of the upper entry surface 60Ab1 of the primary lens 60A and the upper portion of the lower entry surface 60Ab2 of the primary lens 60A are a first region B1, the portion above the lower portion of the upper entry surface 60Ab1 of the primary lens 60A is a second region B2, and a portion below the upper portion of the lower entry surface 60Ab2 of the primary lens 60A is a third region B3, the first region B1 is disposed to match with the focal plane FP of the projection lens 90, the second region B2 is disposed ahead of (or behind) the focal plane FP of the projection lens 90, and the third region B3 is disposed behind (or ahead of) the focal plane FP of the projection lens 90.

The interval between the second region B2 and the focal plane FP of the projection lens 90 increases in the upward direction from the reference axis AX. In contrast, the interval between the third region B3 and the focal plane FP of the projection lens 90 increases in the downward direction from the reference axis AX.

By adjusting the first region B1, the vertical length of the high luminous intensity zone in the vicinity of the cut-off line of the low beam light distribution pattern where the luminous intensity is high, and the vertical length of the high luminous intensity zone in the vicinity of the lower edge of the ADB light distribution pattern where the luminous intensity is relatively high, can be adjusted. Further, by adjusting the second region B2, the vertical length of the low beam light distribution pattern can be adjusted. Furthermore, by adjusting the third region B3, the vertical length of the ADB light distribution can be adjusted.

The secondary lens 80 is made of transparent resin, such as acrylic and polycarbonate, and is a plano-convex lens which includes the front surface 82*a* and the back surface 82*b* on the opposite side of the front surface 82*a*. The front surface 82*a* is a plane that is parallel with a plane including the Y axis and the Z axis, and the back surface 82*b* is a spherical surface which is convex in the backward direction.

Figure 17:
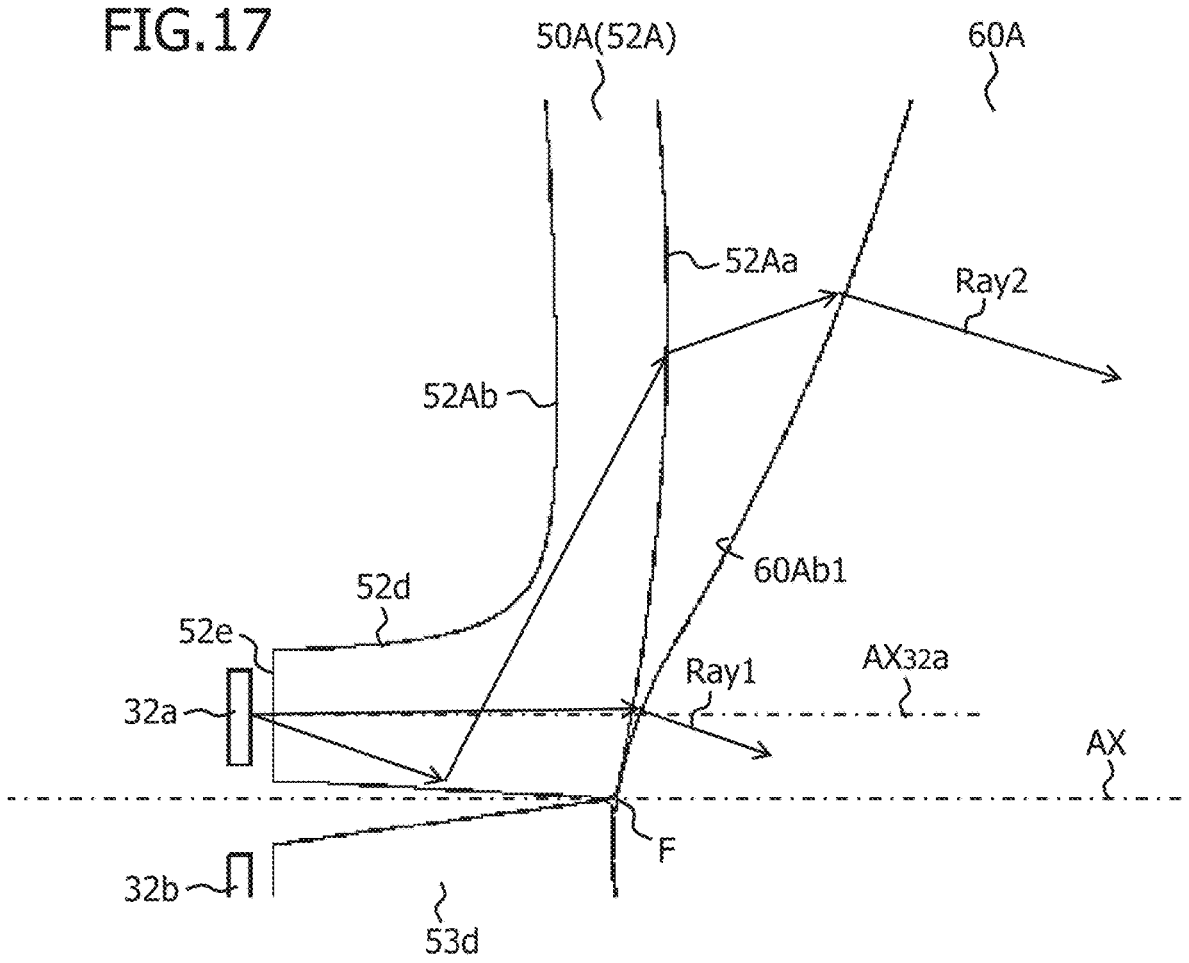
FIG. 17 is a diagram for describing the optical path of the light from the low beam light source 32*a*.

FIG. 17 is a diagram for describing the optical path of the light from the low beam light source 32*a*.

In the vehicular lamp fitting 10A having the above mentioned configuration, when the low beam light source 32*a* is turned ON, the light from the low beam light source 32*a* enters the separator 50A (first light guiding unit 52*d*) through the first entry surface 52*e*.

As illustrated in FIG. 17, a part of the light from the low beam light source 32*a* which entered the separator 50A (first light guiding unit 52*d*), such as the light Ray 1 of which luminous intensity is relatively high (e.g. light in the narrow angle direction with respect to the optical axis $AX_{32a}$ of the low beam light source 32*a*), directly exits through the lower portion of the front surface 52Aa of the upper separator main body 52A, then enters the primary lens 60A through the upper entry surface 60Ab1 of the primary lens 60A, and is projected by the projection lens 90 constituted by the primary lens 60A and the secondary lens 80, so as to form the low beam light distribution pattern.

Figure 27:
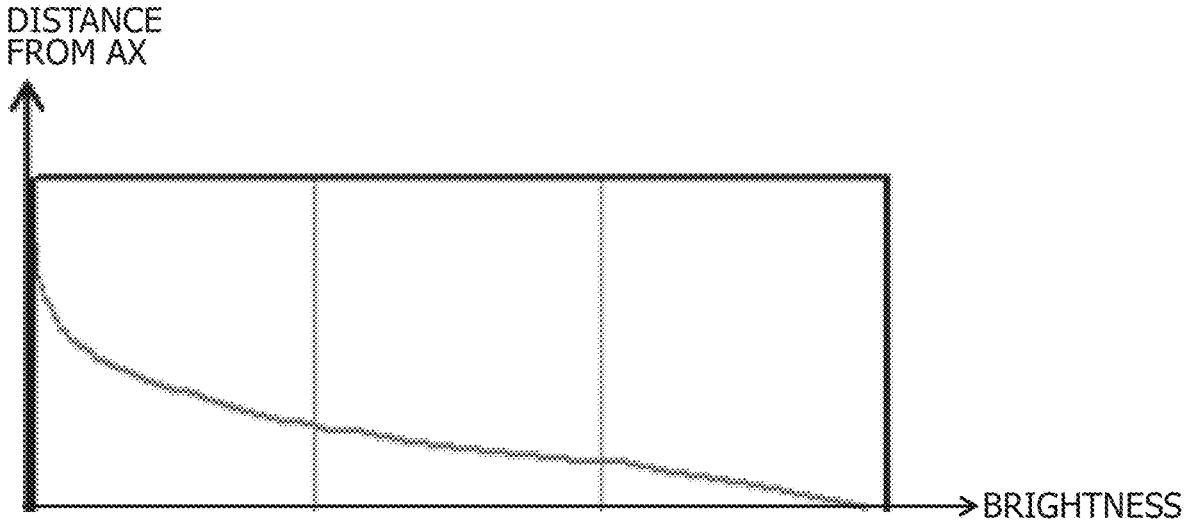
FIG. 27 is a graph depicting the luminous intensity distribution of the light that is guided inside the upper separator main body 52A while repeating the total reflection between the front surface 52Aa and the back surface 52Ab of the upper separator main body 52A, and exits through the front surface 52Aa of the upper separator main body 52A.

Further, another part of the light from the low beam light source 32*a* which entered the separator 50A (first light guiding unit 52*d*), such as the light Ray 2 of which luminous intensity is relatively low (e.g. light in the wide angle direction with respect to the optical axis $AX_{32a}$ of the low beam light source 32*a*) is guided inside the upper separator main body 52A while repeating the total reflection between the front surface 52Aa and the back surface 52Ab of the upper separator main body 52A, and exits through the front surface 52Aa of the upper separator main body 52A, then enters the primary lens 60A through the upper entry surface 60Ab1 of the primary lens 60A, and is projected by the projection lens 90 constituted by the primary lens 60A and the secondary lens 80, so as to form the low beam light distribution pattern. FIG. 27 is a graph depicting the luminous intensity distribution of the light that is guided inside the upper separator main body 52A while repeating the total reflection between the front surface 52Aa and the back surface 52Ab of the upper separator main body 52A, and exits through the front surface 52Aa of the upper separator main body 52A.

Figure 18:
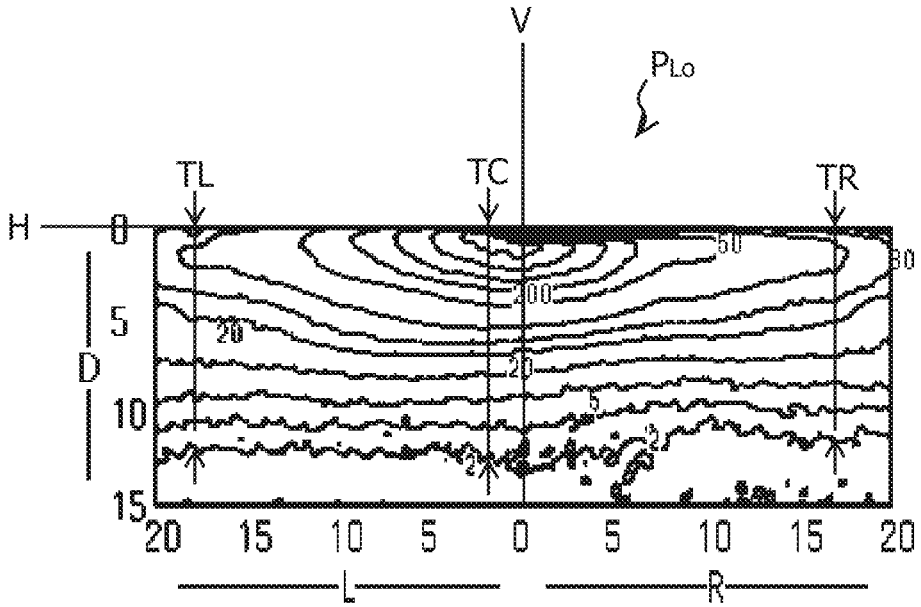
FIG. 18 is an example of the low beam light distribution pattern $P_{Lo}$ formed by the vehicular lamp fitting 10A.

The present inventors confirmed that the low beam light distribution pattern formed as described above: satisfies the regulations specified for the low beam light distribution pattern; suppresses the luminous intensity of a part of the low beam light distribution pattern (e.g. area around 4° below the horizontal line H) from becoming relatively high; and makes the thickness in the vertical direction uniform with respect to the horizontal direction (that is, the thicknesses TC, TL and TR become uniform, and the diminishing of the naturalness of the light distribution is suppressed), as illustrated in FIG. 18. FIG. 18 is an example of the low beam light distribution pattern $P_{Lo}$ formed by the vehicular lamp fitting 10A.

An exact reason as to why the luminous intensity of a part of the low beam light distribution pattern (e.g. area around 4° below the horizontal line) does not become high is unknown, but the following is possible.

Since the space S is formed between the front surface 52Aa of the upper separator main body 52A and the back surface 60Ab (upper entry surface 60Ab1) of the primary lens 60A, the light Ray 1 of which luminous intensity is relatively high, out of the light from the low beam light source 32*a* which enters the separator 50A (first light guiding unit 52*d*), is refracted (diffused) when the light Ray 1 exits through the front surface 52Aa of the upper separator main body 52A and when the light Ray 1 enters the primary lens 60A through the back surface 60Ab (upper entry surface 60Ab1) of the primary lens 60A respectively, and is then Fresnel-reflected. As a result, the light directed to a part of the low beam light distribution pattern (e.g. area around 4° below the horizontal line) decreases.

A precise reason as to why the thickness in the vertical direction becomes uniform with respect to the horizontal direction is unknown, but the following is possible.

That is, since the space S is formed between the front surface 52Aa of the upper separator main body 52A and the back surface 60Ab (upper entry surface 60Ab1) of the primary lens 60A, the light Ray 1 of which luminous intensity is relatively high, out of the light from the low beam light source 32*a* which enters the separator 50A (first light guiding unit 52*d*) is refracted (diffused) when the light Ray 1 enters the primary lens 60A through the back surface 60Ab (upper entry surface 60Ab1) of the primary lens 60A, and a part of the light Ray 1 is projected to a region of the low beam light distribution pattern of which luminous intensity is relatively low (mainly the lower region of the center portion) by the projection lens 90 constituted by the primary lens 60A and the secondary lens 80.

Another possible reason is that the light from the low beam light source 32*a*, which is guided inside the upper separator main body 52A while repeating the total reflection between the front surface 52Aa and the back surface 52Ab of the upper separator main body 52A and exits through the front surface 52Aa of the upper separator main body 52A, is projected to a region of the low beam light distribution pattern of which luminous intensity is relatively low (mainly the lower region of the center portion) by the projection lens 90 constituted by the primary lens 60A and the secondary lens 80.

Figure 19B:
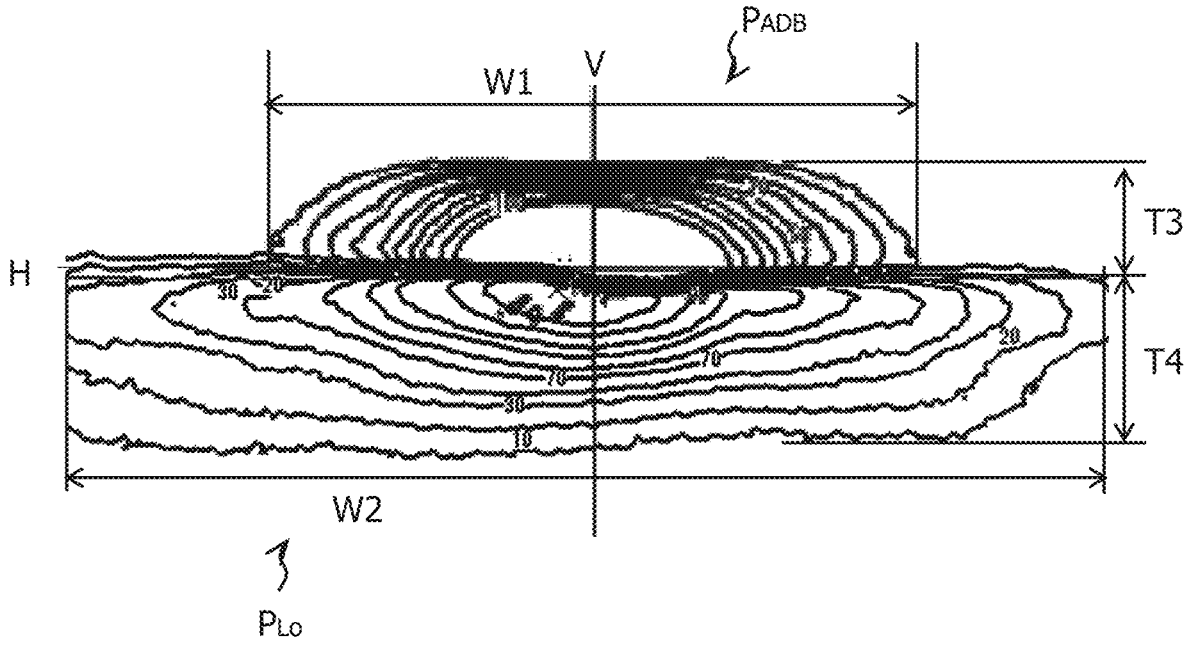
FIG. 19B is an example of a ADB light distribution pattern and a low beam light distribution pattern formed when the separator shown in FIG. 20 (light guiding lens similar to the above-mentioned prior art) is used.

The present inventors confirmed that the low beam light distribution pattern formed as described above has a longer vertical direction (T3<T4 in FIG. 19B), lower density (smaller brightness range), and lower maximum luminous intensity compared with the ADB light distribution pattern $P_{ADB}$, as illustrated in FIG. 19B. FIG. 19B is an example of the ADB light distribution pattern and the low beam light distribution pattern which are formed when the separator 50A in FIG. 20 is used.

A possible reason as to why the low beam light distribution pattern has the longer vertical length compared with the ADB light distribution pattern is because the second region B2 is disposed ahead of (or behind) the focal plane FP of the projection lens 90, hence the light from the low beam light source 32*a*, which exist through the front surface 52Aa of the upper separator main body 52A and enters the primary lens 60A through the upper entry surface 60Ab1 of the primary lens 60A, is projected in a blurred state by the projection lens 90 constituted by the primary lens 60A and the secondary lens 80.

A possible reason as to why the low beam light distribution pattern has the lower density (smaller brightness range) and lower maximum luminous intensity compared with the ADB light distribution pattern is the same as the above mentioned reason as to why the luminous intensity of a part of the low beam light distribution pattern (e.g. area around 4° below the horizontal line) does not become high.

The reason why the width W2 of the low beam light distribution pattern $P_{Lo}$ becomes wider than the width W1 of the ADB light distribution pattern $P_{ADB}$ in FIG. 19B is because the width W4 of the first light guiding unit 52*d*, by which the light from the low beam light source 32*a* is guided, is wider than the width W3 of the second light guiding unit 53*d* by which the light from the ADB light source 32*b* is guided, as illustrated in FIG. 15B.

When the ADB light source 32*b* is turned ON, the ADB light distribution pattern $P_{ADB}$ is formed, and when the low beam light source 32*a* and the ADB light source 32*b* are turned ON, a composite light distribution pattern, which includes the low beam light distribution pattern $P_{Lo}$ and the ADB light distribution pattern $P_{ADB}$, is formed. Since this aspect is the same as Embodiment 1, description thereof is omitted.

Furthermore, the present inventors confirmed that the contour of the ADB light distribution pattern formed as described above is moderately blurred.

A possible reason as to why the contour of the ADB light distribution pattern is moderately blurred is because the third region B3 is disposed behind (or ahead of) the focal plane FP of the projection lens 90, hence the light from the ADB light source 32*b*, which exits through the front surface 53*a* of the lower separator main body 53 and enters the primary lens 60A through the lower entry surface 60Ab2 of the primary lens 60A, is projected in the blurred state by the projection lens 90 constituted by the primary lens 60A and the secondary lens 80.

As described above, according to the present embodiment, the vehicular lamp fitting 10A, which forms a low beam light distribution pattern which has a longer vertical direction, lower density (smaller brightness range) and lower maximum luminous intensity compared with the ADB light distribution pattern, and an ADB light distribution pattern of which contour is moderately blurred, can be provided.

Further, according to the present embodiment, the vehicular lamp fitting 10A forms a lower beam light distribution pattern which suppresses the luminous intensity of a part of the low beam light distribution pattern (e.g. area around 4° below the horizontal light), from becoming relatively high, and makes the thickness in the vertical direction uniform with respect to the horizontal direction (that is, suppresses the diminishing of the naturalness of the light distribution), can be provided.

Figure 22A:
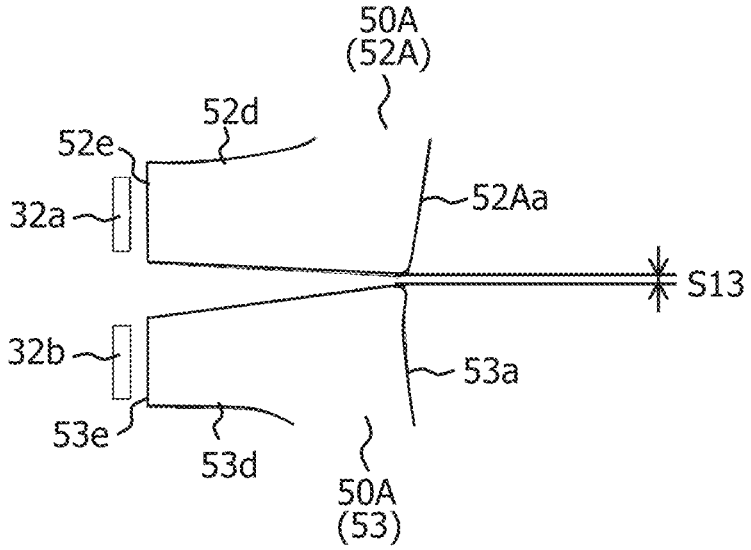
FIG. 22A is a diagram for describing a space S13 between the front surface 52Aa of the upper separator main body 52A and the front surface 53*a* of the lower separator main body 53 from which the light from the ADB light source 32*b* is emitted.
Figure 22B:
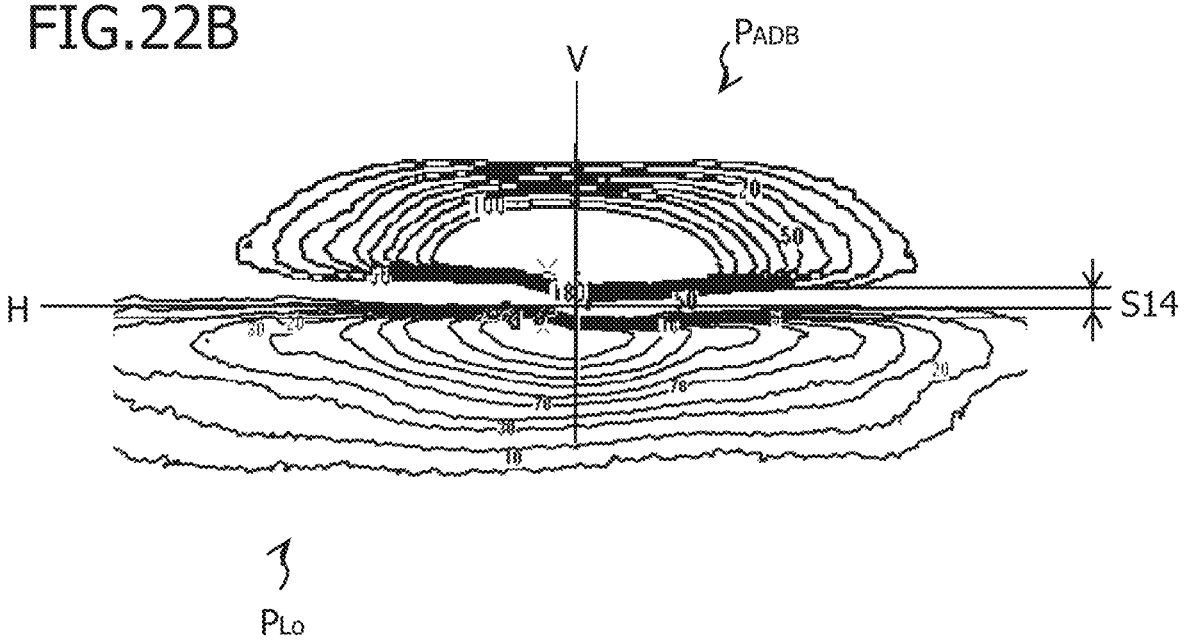
FIG. 22B is an example of a composite light distribution pattern which includes a low beam light distribution pattern and an ADB light distribution pattern P, which is formed when the space S13 is generated.

According to the study of the present inventors, it was discovered that in the vehicular lamp fitting 10A having the above configuration, a space S13 may be generated in some cases between the front surface 52Aa of the upper separator main body 52A through which the light from the low beam light source 32*a* and the front surface 53*a* of the lower separator main body 53 through which the light from the ADB light source 32*b* exits, due to the molding variations of the separator 50A and the change in temperature, as illustrated in FIG. 22A, and when this space S13 is generated, the luminous intensity between the low beam light distribution pattern $P_{Lo}$ and the ADB light distribution pattern $P_{ADB}$ (see the space indicated by the reference sign S14 in FIG. 22A) suddenly drops and the naturalness of the light distribution diminishes, as illustrated in FIG. 22B. FIG. 22A is a diagram for describing the space S13 between the front surface 52Aa of the upper separator main body 52A and the front surface 53*a* of the lower separator main body 53 through which the light from the ADB light source 32*b* exits, and FIG. 22B is an example of the composite light distribution pattern including the low beam light distribution pattern and the ADB light distribution pattern, which is formed in the case when the space S13 is formed.

Now as Embodiment 3, a vehicular lamp fitting 10B, which makes the luminous intensity change between the low beam light distribution pattern $P_{Lo}$ and the ADB light distribution pattern $P_{ADB}$ become smooth and suppresses the diminishing of the naturalness of the light distribution, even if the space S13 is generated between the front surface 52Aa of the upper separator main body 52A through which the light from the low beam light source 32*a* exits and the front surface 53*a* of the lower separator main body 53 through which the light from the ADB light source 32*b* exits, will be described.

A difference of the vehicular lamp fitting 10B of the present embodiment from the above described vehicular lamp fitting 10A of Embodiment 2 is that a separator 50B is used instead of the separator 50A. The rest of the configuration is the same as Embodiment 2. In the following, the differences from Embodiment 2 will be primarily described, and a composing element the same as Embodiment 2 is denoted with the same reference sign, and description thereof may be omitted.

Figure 23:
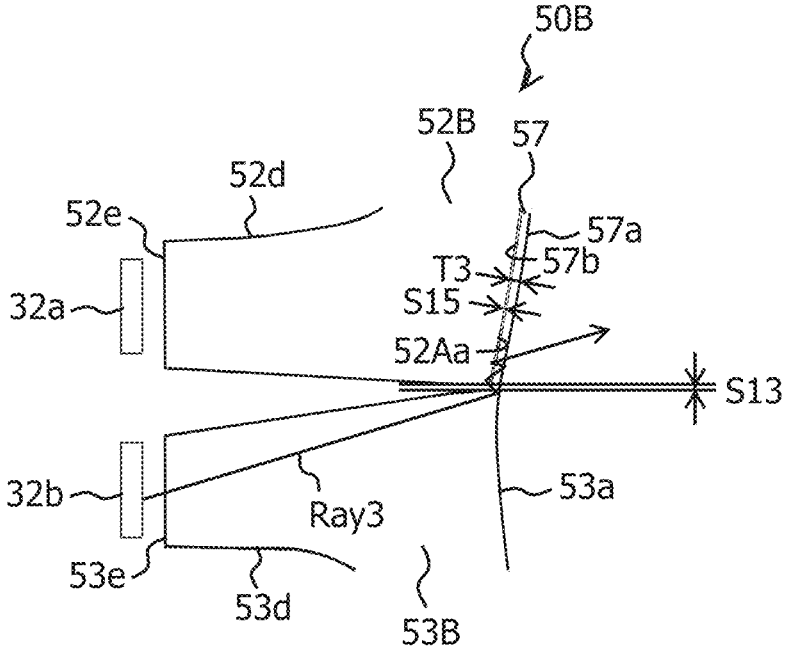
FIG. 23 is a partial longitudinal cross-sectional view of the separator 50B.
Figure 24A:
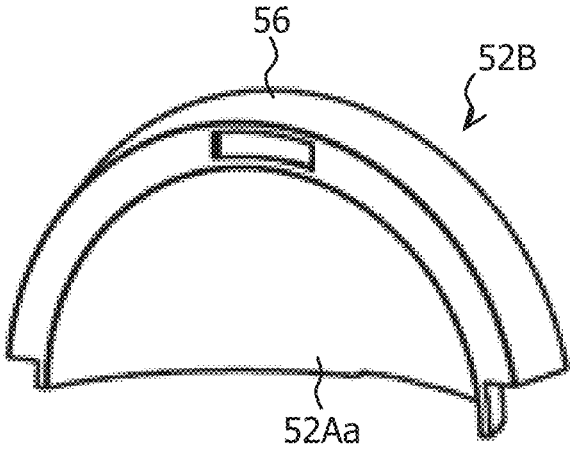
FIG. 24A is a perspective view of the upper separator main body 52B.

FIG. 23 is a partial longitudinal cross-sectional view of the separator 50B. FIG. 24A is a perspective view of the upper separator main body 52B, and FIG. 24B is a perspective view of the lower separator main body 53B.

Figure 24B:
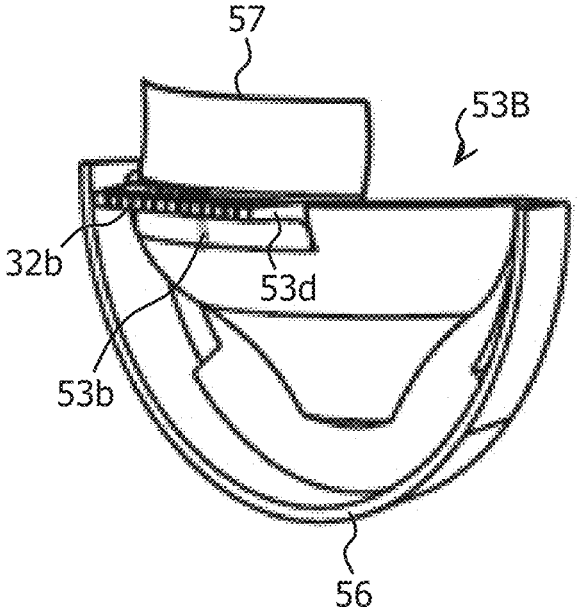
FIG. 24B is a perspective view of the lower separator main body 53B.

The separator 50B illustrated in FIG. 23 is configured by combining the upper separator main body 52B and the lower separator main body 53B illustrated in FIG. 24A and FIG. 24B.

As illustrated in FIG. 23 and FIG. 24B, a difference of the separator 50B from the above mentioned separator 50A of Embodiment 2 is that the upper portion of the front end of the lower separator main body 53B includes an overlap unit 57 which extends upward. The rest of the configuration is the same as the separator 50A of Embodiment 2. In the following, the difference from the separator 50A of Embodiment 2 will be primarily described, and a composing element the same as the separator 50A is denoted with the same reference sign, and description thereof may be omitted.

As illustrated in FIG. 23, the overlap unit 57 is a thin film type light guiding unit which includes: a front surface 57*a* facing the upper entry surface 60Ab1 (not illustrated in FIG. 23) of the primary lens 60A; a space S13 between the lower portion of the upper separator main body 52B (front surface 52Aa) and the upper portion of the lower separator main body 53B (front surface 53*a*); and the back surface 57*b* facing the front surface 52Aa of the upper separator main body 52B.

The thickness T3 of the overlap unit 57 is 0.2 mm, for example. In order to suppress a drop in the transmittance of the light from the low beam light source 32*a*, which exits through the front surface 52Aa of the upper separator main body 52B, it is preferable that the thickness T3 of the overlap unit 57 is as thin as possible.

The overlap unit 57 is disposed in a state where the space S15 is formed between the back surface 57*b* of the overlap unit 57 and the front surface 52Aa of the upper separator main body 52B so that a light Ray 3 from the ADB light source 32*b*, which is guided inside the overlap unit 57 while repeating the total reflection between the front surface 57*a* and the back surface 57*b* of the overlap unit 57, exits through the front surface 57*a* of the overlap unit 57. The space S15 is about 0.02 mm, for example.

In the vehicular lamp fitting 10B having the above mentioned configuration, when the low beam light source 32*a* and the ADB light source 32*b* are simultaneously turned ON, the light from the low beam light source 32*a* enters the separator 50B (first light guiding unit 52*d*) through the first entry surface 52*e*.

A part of the light from the low beam light source 32*a* which entered the separator 50B (first light guiding unit 52*d*), such as the light Ray 1 of which luminous intensity is relatively high (e.g. see FIG. 17), directly exits through the lower portion of the front surface 52Aa of the upper separator main body 52B, passes through the overlap unit 57, then enters the primary lens 60A through the upper entry surface 60Ab1 of the primary lens 60A, and is projected by the projection lens 90 constituted by the primary lens 60A and the secondary lens 80, so as to form the low beam light distribution pattern.

Further, another part of the light from the low beam light source 32*a* which entered the separator 50B (first light guiding unit 52*d*), such as the light Ray 2 of which luminous intensity is relatively low (see FIG. 17), is guided inside the upper separator main body 52B while repeating the total reflection between the front surface 52Aa and the back surface 52Ab of the upper separator main body 52B, exits from the front surface 52Aa of the upper separator main body 52B, passes through the overlap unit 57, then enters the primary lens 60A through the upper entry surface 60Ab1 of the primary lens 60A, and is projected by the projection lens 90 constituted by the primary lens 60A and the secondary lens 80, so as to form the low beam light distribution pattern.

Meanwhile, the light from the ADB light source 32*b* enters the separator 50B (second light guiding unit 53*d*) through the second entry surface 53*e*.

A part of the light from the ADB light source 32*b* which entered the separator 50B (second light guiding unit 53*d*) directly exits through the upper portion of the front surface 53*a* of the lower separator main body 53B, then enters the primary lens 60A through the lower entry surface 60Ab2 of the primary lens 60A, and is projected by the projection lens 90 constituted by the primary lens 60A and the secondary lens 80, so as to form the ADB light distribution pattern.

Further, as illustrated in FIG. 23, another part of the light from the ADB light source 32*b* (see Ray 3 in FIG. 23) which entered the separator 50B (second light guiding unit 53*d*) is guided inside the overlap unit 57 while repeating the total reflection between the front surface 57*a* and the back surface 57*b* of the overlap unit 57, and exits through the front surface 57*a* of the overlap unit 57, then is projected between the low beam light distribution pattern (lower portion) and the ADB light distribution pattern (upper portion) by the projection lens 90 constituted by the primary lens 60A and the secondary lens 80.

Figure 25:
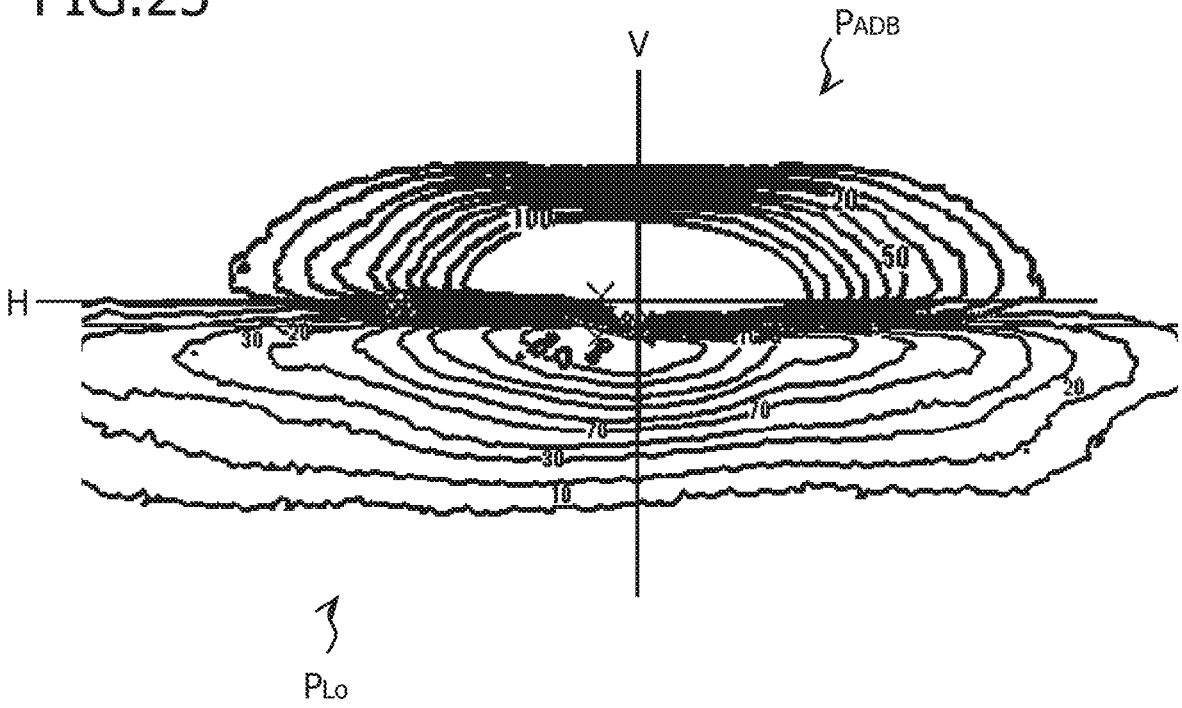
FIG. 25 is an example of the composite light distribution pattern including the low beam light distribution pattern $P_{Lo}$ and the ADB light distribution pattern $P_{ADB}$ formed by the vehicular lamp fitting 10B.

The present inventors confirmed that the composite light distribution pattern, including the low beam light distribution pattern and the ADB light distribution pattern which is formed as above, makes the luminous intensity change between the low beam light distribution pattern $P_{Lo}$ and the ADB light distribution pattern $P_{ADB}$ become smooth, and suppresses the diminishing of the naturalness of the light distribution, as illustrated in FIG. 25. FIG. 25 is an example of the composite light distribution pattern including the low beam light distribution pattern $P_{Lo}$ and the ADB light distribution pattern $P_{ADB}$ formed by the vehicular lamp fitting 10B.

As described above, according to the present embodiment, the vehicular lamp fitting 10B, which makes the luminous intensity change between the low beam light distribution pattern $P_{Lo}$ and the ADB light distribution pattern $P_{ADB}$ become smooth, and suppresses the diminishing of the naturalness of the feeling of light distribution, even if the space S13 is formed between the front surface 52Aa of the upper separator main body 52B through which the light from the low beam light source 32*a* exits and the front surface 53*a* of the lower separator main body 53B through which the light from the ADB light source 32*b* exits, can be provided.

Modifications will be described next.

Figure 26:
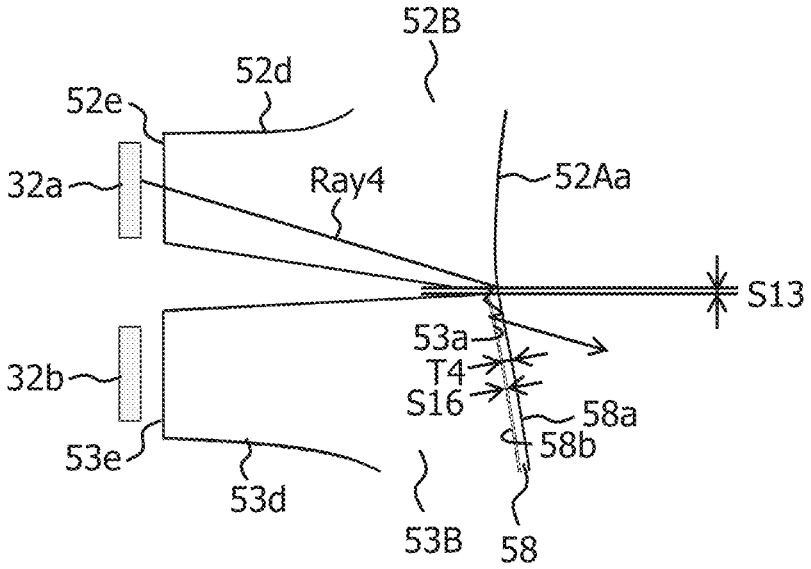
FIG. 26 is a partial longitudinal cross-sectional view of the separator 50B (modification).

FIG. 26 is a partial longitudinal cross-sectional view of the separator 50B (modification).

The overlap unit described in Embodiment 3 is the overlap unit 57 of which upper portion of the front end of the lower separator main body 53B extends upward, but the present invention is not limited to this. For example, as illustrated in FIG. 26, the overlap unit may be an overlap unit 58 of which lower portion of the front end of the upper separator main body 52B extends downward.

The overlap unit 58 is a thin film type light guiding unit, which includes: a front surface 58*a* facing the lower entry surface 60Ab2 (not illustrated in FIG. 26) of the primary lens 60A; a space S13 between the lower portion of the upper separator main body 52B (front surface 52Aa) and the upper portion of the lower separator main body 53B (front surface 53*a*); and a back surface 58*b* facing the front surface 53*a* of the lower separator main body 53B.

The thickness T4 of the overlap unit 58 is 0.2 mm, for example. In order to suppress the drop in transmittance of the light from the ADB light source 32*b* which exits through the front surface 53*a* of the lower separator main body 53B, it is preferable that the thickness T4 of the overlap unit 58 is as thin as possible.

The overlap unit 58 is disposed in a state where the space S16 is formed between the back surface 58*b* of the overlap unit 58 and the front surface 53*a* of the lower separator main body 53B, so that the light from the low beam light source 32*a*, which is guided inside the overlap unit 58 while repeating the total reflection between the front surface 58*a* and the back surface 58*b* of the overlap unit 58, exits through the front surface 58*a* of the overlap unit 58. The space S16 is about 0.02 mm, for example.

In this modification, when the low beam light source 32*a* and the ADB light source 32*b* are simultaneously turned ON, the light from the low beam light source 32*a* enters the separator 50B (first light guiding unit 52*d*) through the first entry surface 52*e*.

The light Ray 1 of which luminosity intensity is relatively high (see FIG. 17), out of the light from the low beam light source 32*a* which entered the separator 50B (first light guiding unit 52*d*), directly exits through the lower portion of the front surface 52Aa of the upper separator main body 52B, passes through the overlap unit 58, then enters the primary lens 60A through the upper entry surface 60Ab1 of the primary lens 60A, and is projected by the projection lens 90 constituted by the primary lens 60A and the secondary lens 80, so as to form the low beam light distribution pattern.

The light Ray 2 of which luminous intensity is relatively low (see FIG. 17), out of the light from the low beam light source 32*a* which entered the separator 50B (first light guiding unit 52*d*), is guided inside the upper separator main body 52B while repeating the total reflection between the front surface 52Aa and the back surface 52Ab of the upper separator main body 52B, and exits through the front surface 52Aa of the upper separator main body 52B, then enters the primary lens 60A through the upper entry surface 60Ab1 of the primary lens 60A, and is projected by the projection lens 90 constituted by the primary lens 60A and the secondary lens 80, so as to form the low beam light distribution pattern.

Further, another part (Ray 4 in FIG. 26) of the light from the low beam light source 32*a* which entered the separator 50B (first light guiding unit 52*d*), is guided inside the overlap unit 58 while repeating the total reflection between the front surface 58*a* and the back surface 58*b* of the overlap unit 58, and exits through the front surface 58*a* of the overlap unit 58, then is projected between the low beam light distribution pattern (lower portion) and the ADB light distribution pattern (upper portion) by the projection lens 90 constituted by the primary lens 60A and the secondary lens 80.

Meanwhile, the light from the ADB light source 32*b* enters the separator 50B (second light guiding unit 53*d*) through the second entry surface 53*e*.

A part of the light from the ADB light source 32*b*, which entered the separator 50B (second light guiding unit 53*d*), directly exits through the upper portion of the front surface 53*a* of the lower separator main body 53B, then enters the primary lens 60A through the lower entry surface 60Ab2 of the primary lens 60A, and is projected by the projection lens 90 constituted by the primary lens 60A and the secondary lens 80, so as to form the ADB light distribution pattern.

The present inventors confirmed that the composite light distribution pattern including the low beam light distribution pattern and the ADB light distribution pattern, which is formed as described above, makes the luminous intensity change between the low beam light distribution pattern $P_{Lo}$ and the ADB light distribution pattern $P_{ADB}$ become smooth, and suppresses the diminishing of the naturalness of the light distribution, as illustrated in FIG. 25.

In the description of Embodiment 3, the overlap unit 57 is applied to the separator 50A of the vehicular lamp fitting 10A of Embodiment 2, but the present invention is not limited to this. For example, the overlap unit 57 may be applied to the separator 50 of the vehicular lamp fitting 10A of Embodiment 1, or other separators. This is the same for the overlap unit 58 as well.

In the description of the above embodiments, the projection lens is the projection lens 90 constituted by two lenses (the primary lens 60A and the secondary lens 80), but the present invention is not limited to this. For example, the projection lens may be a projection lens constituted by one lens, or a projection lens constituted by three or more lenses (not illustrated).

Figure 21:
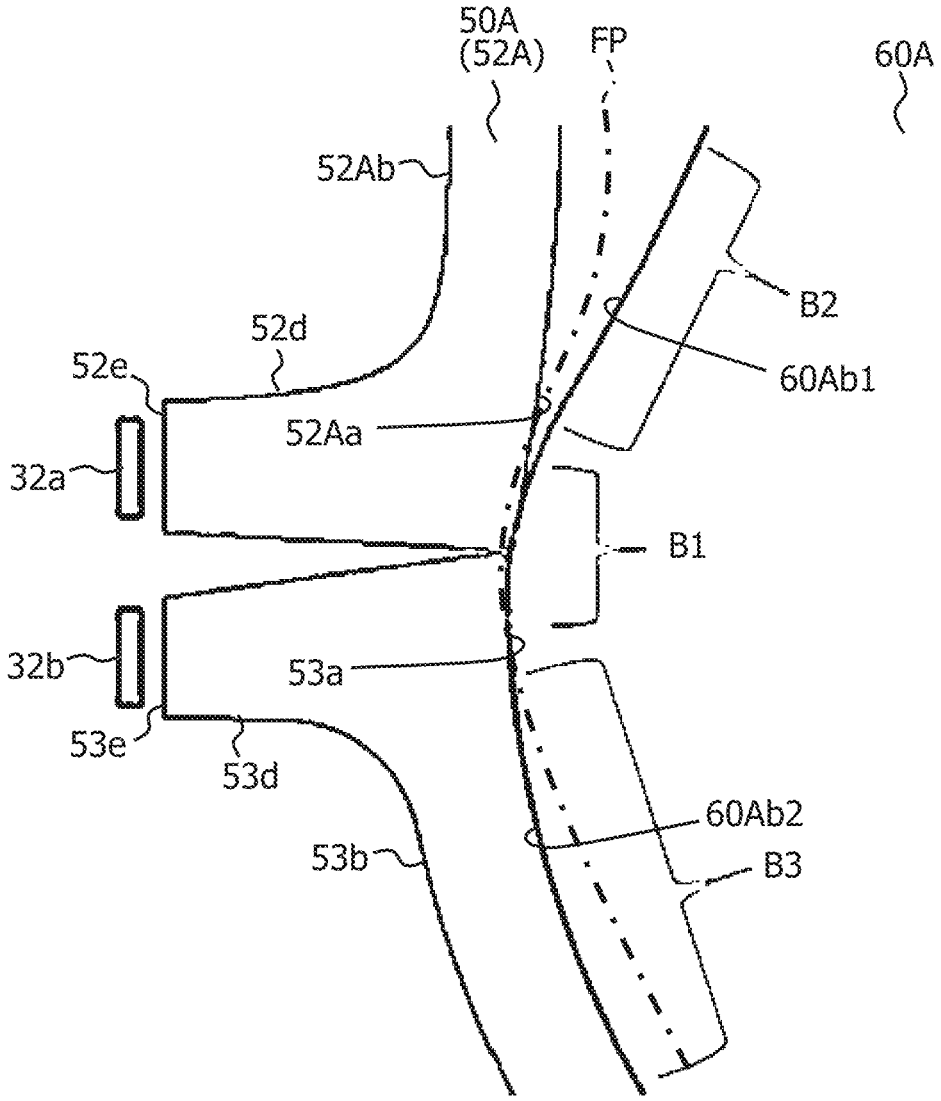
FIG. 21 is a modification of the focal plane FP of the projection lens 90.

Further, in the description of the above embodiments, the focal plane FP of the projection lens 90 is a spherical surface of which curvature is constant (see FIG. 20), but the present invention is not limited to this. For example, as illustrated in FIG. 21, the focal plane FP of the projection lens 90 may be a spherical surface of which curvature changes unevenly. FIG. 21 is a modification of the focal plane FP of the projection lens 90.

All the numeric values of each of the embodiments are given only for illustration purpose, and appropriate numeric values different from these numeric values can be, of course, used.

Each of the embodiments is given only for illustration purpose in all respects. The present invention is not limited to each of the embodiments in its interpretation. The present invention can be carried out in various ways without departing from its spirit or principal feature.

The invention claimed is:

1. A vehicular lamp fitting, comprising: a projection lens; a separator that is disposed behind the projection lens; a low beam light source that is disposed behind the separator, and emits light which passes through the separator and the projection lens in sequence, and is irradiated forward to form a low beam light distribution pattern, further comprising an Adaptive Driving Beam (ADB) light source that emits light which passes through the separator and the projection lens in sequence, and is irradiated forward to form an ADB light distribution pattern, wherein the separator includes: an upper separator main body constituted by a front surface and a back surface on the opposite side of the front surface; a first light guiding unit which extends from a lower portion of the upper separator main body toward the low beam light source, and has a first entry surface facing the low beam light source at the front end; a lower separator main body constituted by a front surface and a back surface on the opposite side of the front surface; and a second light guiding unit which extends from an upper portion of the lower separator main body toward the ADB light source, and has a second entry surface facing the ADB light source at the front end, the projection lens includes a front surface and a back surface on the opposite side of the front surface, the back surface of the projection lens includes an upper entry surface facing the front surface of the upper separator main body, and a lower entry surface facing the front surface of the lower separator main body, the low beam light source, the first light guiding unit, the upper separator main body and the upper entry surface are disposed above a reference axis, which passes through a focal point of the projection lens and extends in the longitudinal direction of the vehicle, the ADB light source, the second light guiding unit, the lower separator main body and the lower entry surface are disposed below the reference axis, and when it is assumed that a first region is a lower portion of an upper entry surface of the projection lens and an upper portion of a lower entry surface of the projection lens, a second region is a portion above the lower portion of the upper entry surface of the projection lens, and a third region is a portion below the upper portion of the lower entry surface of the projection lens, the first region matches the focal plane of the projection lens, the second region is disposed ahead of or behind the focal plane of the projection lens, and the third region is disposed ahead of or behind the focal plane of the projection lens.

2. The vehicular lamp fitting according to claim 1, wherein the lower portion of the front surface of the upper separator main body is surface-contacted with the lower portion of the upper entry surface of the projection lens, a space is formed between a portion above the lower portion of the front surface of the upper separator main body and a portion above the lower portion of the upper entry surface of the projection lens, and the front surface of the lower separator main body is surface-contacted with the lower entry surface of the projection lens.

3. The vehicular lamp fitting according to claim 1, wherein the projection lens is constituted by optical surfaces of one or more lenses, except for the back surface of a last disposed lens of the one or more lenses.

4. A vehicular lamp fitting, comprising: a projection lens; a separator that is disposed behind the projection lens; a low beam light source that is disposed behind the separator, and emits light which passes through the separator and the projection lens in sequence, and is irradiated forward to form a low beam light distribution pattern, further comprising an Adaptive Driving Beam (ADB1 light source that emits light which passes through the separator and the projection lens in sequence, and is irradiated forward to form an ADB light distribution pattern, wherein the separator includes: an upper separator main body constituted by a front surface and a back surface on the opposite side of the front surface; a first light guiding unit which extends from a lower portion of the upper separator main body toward the low beam light source, and has a first entry surface facing the low beam light source at the front end; a lower separator main body constituted by a front surface and a back surface on the opposite side of the front surface; and a second light guiding unit which extends from an upper portion of the lower separator main body toward the ADB light source, and has a second entry surface facing the ADB light source at the front end, the projection lens includes a front surface and a back surface on the opposite side of the front surface, the back surface of the projection lens includes an upper entry surface facing the front surface of the upper separator main body, and a lower entry surface facing the front surface of the lower separator main body, the low beam light source, the first light guiding unit, the upper separator main body and the upper entry surface are disposed above a reference axis, which passes through a focal point of the projection lens and extends in the longitudinal direction of the vehicle, the ADB light source, the second light guiding unit, the lower separator main body and the lower entry surface are disposed below the reference axis, and the lower portion of the front surface of the upper separator main body is surface-contacted with the lower portion of the upper entry surface of the projection lens, and a space is formed between a portion above the lower portion of the front surface of the upper separator main body and a portion above the lower portion of the upper entry surface of the projection lens.

5. A vehicular lamp fitting, comprising: a projection lens; a separator that is disposed behind the projection lens; a low beam light source that is disposed behind the separator, and emits light which passes through the separator and the projection lens in sequence, and is irradiated forward to form a low beam light distribution pattern, wherein the separator includes: an upper separator main body constituted by a front surface and a back surface on the opposite side of the front surface; a first light guiding unit which extends from a lower portion of the upper separator main body toward the low beam light source, and has a first entry surface facing the low beam light source at the front end, the projection lens includes a front surface and a back surface on the opposite side of the front surface, the back surface of the projection lens includes an upper entry surface facing the front surface of the upper separator main body, the low beam light source, the first light guiding unit, the upper separator main body and the upper entry surface are disposed above a reference axis, which passes through a focal point of the projection lens and extends in the longitudinal direction of the vehicle, and when it is assumed that a first region is a lower portion of an upper entry surface of the projection lens, and a second region is a portion above the lower portion of the upper entry surface of the projection lens, the first region matches the focal plane of the projection lens, and the second region is disposed ahead of or behind the focal plane of the projection lens.

6. A vehicular lamp fitting, comprising: a projection lens; a separator that is disposed behind the projection lens; a low beam light source that is disposed behind the separator, and emits light which passes through the separator and the projection lens in sequence, and is irradiated forward to form a low beam light distribution pattern, wherein the separator includes: an upper separator main body constituted by a front surface and a back surface on the opposite side of the front surface; a first light guiding unit which extends from a lower portion of the upper separator main body toward the low beam light source, and has a first entry surface facing the low beam light source at the front end, the projection lens includes a front surface and a back surface on the opposite side of the front surface, the back surface of the projection lens includes an upper entry surface facing the front surface of the upper separator main body, the low beam light source, the first light guiding unit, the upper separator main body and the upper entry surface are disposed above a reference axis, which passes through a focal point of the projection lens and extends in the longitudinal direction of the vehicle, the lower portion of the front surface of the upper separator main body is surface-contacted with the lower portion of the upper entry surface of the projection lens, and a space is formed between a portion above the lower portion of the front surface of the upper separator main body and a portion above the lower portion of the upper entry surface of the projection lens.

7. The vehicular lamp fitting according to claim 2, wherein the projection lens is constituted by optical surfaces of one or more lenses, except for the back surface of a last disposed lens of the one or more lenses.

8. The vehicular lamp fitting according to claim 1, wherein a lower edge of the front surface of the upper separator main body includes a stepped edge having a shape corresponding to a cut-off line, and an extended edge which is disposed on at least one side of the stepped edge, and a base end portion of the first light guide portion is provided in a partial region of a rear surface of the upper separator main body including the stepped edge portion.

9. The vehicular lamp fitting according to claim 1, wherein a width of the first light guiding unit is wider than a width of the second light guiding unit.

10. The vehicular lamp fitting according to claim 1, wherein a space is provided between the lower portion of the front surface of the upper separator main body and the upper portion of the front surface of the lower separator main body, the upper portion of the front end of the lower separator main body includes an overlap unit which extends upward, and the overlap unit includes the back surface facing the space and the front surface of the upper separator main body.

11. The vehicular lamp fitting according to claim 1, wherein a space is provided between the lower portion of front surface of the upper separator main body and the upper portion of the front surface of the lower separator main body, the lower portion of the front end of the upper separator main body includes an overlap unit which extends downward, and the overlap unit includes the back surface facing the space and the front surface of the lower separator main body.

12. The vehicular lamp fitting according to claim 4, wherein a lower edge of the front surface of the upper separator main body includes a stepped edge having a shape corresponding to a cut-off line, and an extended edge which is disposed on at least one side of the stepped edge, and a base end portion of the first light guide portion is provided in a partial region of the rear surface of the upper separator main body including the stepped edge portion.

13. The vehicular lamp fitting according to claim 4, wherein a width of the first light guiding unit is wider than a width of the second light guiding unit.

14. The vehicular lamp fitting according to claim 4, wherein a space is provided between the lower portion of front surface of the upper separator main body and the upper portion of the front surface of the lower separator main body, the upper portion of the front end of the lower separator main body includes an overlap unit which extends upward, and the overlap unit includes the back surface facing the space and the front surface of the upper separator main body.

15. The vehicular lamp fitting according to claim 4, wherein a space is provided between the lower portion of front surface of the upper separator main body and the upper portion of the front surface of the lower separator main body, the lower portion of the front end of the upper separator main body includes an overlap unit which extends downward, and the overlap unit includes the back surface facing the space and the front surface of the lower separator main body.

16. The vehicular lamp fitting according to claim 5, wherein the lower portion of the front surface of the upper separator main body is surface-contacted with the lower portion of the upper entry surface of the projection lens, a space is formed between a portion above the lower portion of the front surface of the upper separator main body and a portion above the lower portion of the upper entry surface of the projection lens, and an interval forming the space between the front surface of the upper separator main body and the upper entry surface of the projection lens increases in an upward direction.

17. The vehicular lamp fitting according to claim 5, wherein a lower edge of the front surface of the upper separator main body includes a stepped edge having a shape corresponding to a cut-off line, and an extended edge which is disposed on at least one side of the stepped edge, and a base end portion of the first light guide portion is provided in a partial region of the rear surface of the upper separator main body including the stepped edge portion.

18. The vehicular lamp fitting according to claim 6, wherein the lower edge of the front surface of the upper separator main body includes a stepped edge having a shape corresponding to a cut-off line, and an extended edge which is disposed on at least one side of the stepped edge, and a base end portion of the first light guide portion is provided in a partial region of the rear surface of the upper separator main body including the stepped edge portion.

* * * * *